US007721461B2

(12) United States Patent
Ishii et al.

(10) Patent No.: US 7,721,461 B2
(45) Date of Patent: May 25, 2010

(54) METHOD AND APPARATUS FOR DRYING HONEYCOMB FORMED BODY

(75) Inventors: Takeyuki Ishii, Nagoya (JP); Yuji Asai, Chita (JP); Makoto Nakajo, Nagoya (JP)

(73) Assignee: NGK Insulators, Ltd., Nagoya (JP)

( * ) Notice: Subject to any disclaimer, the term of this patent is extended or adjusted under 35 U.S.C. 154(b) by 438 days.

(21) Appl. No.: 10/569,881

(22) PCT Filed: Sep. 2, 2004

(86) PCT No.: PCT/JP2004/012737

§ 371 (c)(1),
(2), (4) Date: Feb. 28, 2006

(87) PCT Pub. No.: WO2005/023503

PCT Pub. Date: Mar. 17, 2005

(65) Prior Publication Data

US 2007/0006480 A1 Jan. 11, 2007

(30) Foreign Application Priority Data

Sep. 2, 2003 (JP) ..... 2003-310037
Sep. 18, 2003 (JP) ..... 2003-326169

(51) Int. Cl.
*F26B 3/34* (2006.01)

(52) U.S. Cl. ..... 34/265; 34/259; 34/105; 264/417

(58) Field of Classification Search ..... 264/413, 264/416, 417, 432, 489, 297.8; 34/259, 263, 34/264, 265, 236, 593, 184, 186, 187, 105; 198/465.1, 465.3, 378
See application file for complete search history.

(56) References Cited

U.S. PATENT DOCUMENTS 2,830,462 A * 4/1958 Vettese ..... 74/422
3,872,603 A * 3/1975 Williams et al. ..... 34/265
4,409,453 A * 10/1983 Smith ..... 219/684
5,756,036 A * 5/1998 Grosswald et al. ..... 264/304

(Continued)

FOREIGN PATENT DOCUMENTS

JP A-2000-337775 12/2000

(Continued)

*Primary Examiner*—Kenneth B Rinehart
(74) *Attorney, Agent, or Firm*—Oliff & Berridge PLC

(57) ABSTRACT

An undried honeycomb formed body 41 is subjected to high-frequency heating in an atmosphere where humidity and temperature are maintained at 30 to 65% and 75 to 130° C., respectively, such that 50 to 99 mass % of water contained in the undried honeycomb formed body 41 is evaporated at the end of high-frequency heating, whereby the amount of water vaporized from the outer part of the undried honeycomb formed body 41 is increased, thereby reducing a difference between amount of water vaporized from the inner part of the undried honeycomb formed body 41 and that of water vaporized from the outer part thereof as well as reducing a difference between drying degree of the inner part of the undried honeycomb formed body 41 and that of the outer part thereof, thereby producing a dried honeycomb formed body 42 in which deformation of the partition walls is suppressed. The invention provides a honeycomb formed body drying method which prevents deformation of partition walls of the honeycomb formed body during drying thereof.

41 Claims, 10 Drawing Sheets

U.S. PATENT DOCUMENTS

| | | | |
|---|---|---|---|
| 2002/0093123 | A1 | 7/2002 | Miura et al. |
| 2002/0109269 | A1 | 8/2002 | Miura et al. |

FOREIGN PATENT DOCUMENTS

| | | |
|---|---|---|
| JP | A-2002-234780 | 8/2002 |
| JP | A-2002-283329 | 10/2002 |
| JP | A-2002-283330 | 10/2002 |
| JP | A-2005-14421 | 1/2005 |
| JP | A-2005-75660 | 3/2005 |

* cited by examiner

METHOD AND APPARATUS FOR DRYING HONEYCOMB FORMED BODY

TECHNICAL FIELD

The present invention relates to a method and an apparatus for drying a honeycomb formed body and, more particularly, to a method and an apparatus for drying a honeycomb formed body which prevent deformation such as warpage of partition walls of the honeycomb formed body during drying thereof.

BACKGROUND ART

Generally, ceramic-based honeycomb structures are produced through a procedure of, for example, molding (e.g., extruding) a raw material composition containing a predetermined ceramic source and water to thereby form a honeycomb formed body having a plurality of cells defined by partition walls, each cell serving as a fluid conduit; drying the honeycomb formed body; and firing the dried honeycomb formed body.

Among the above production steps for a ceramic honeycomb structure, drying of a honeycomb formed body is carried out by means of, for example, hot air or high-frequency heating employing an electromagnetic wave. In electromagnetic wave drying, an electromagnetic wave of high-frequency region (high-frequency wave) capable of heating water is applied to a honeycomb formed body, whereby water is vaporized so as to dry the honeycomb formed body (see, for example, Patent Document 1). As compared with drying with hot air, electromagnetic wave drying more effectively dries from an inner part of a honeycomb formed body. However, in this case, the outer part of the formed body is difficult to dry as compared with the inner part, which is problematic.

In addition, when a honeycomb formed body has a thin outer wall or partition walls, drying by means of high-frequency heating employing an electromagnetic wave raises a problem. Specifically, due to the structural nature, the outer part of the thus-dried formed body is not readily dried as compared with the inner part thereof, wrinkles and dents generate in the outer periphery, whereby warpage of partition walls, and other deformation are problematically generated. The characteristic feature of the method for drying a honeycomb formed body described in Patent Document 1 is that the humidity of an atmosphere including a honeycomb formed body is elevated during electromagnetic wave drying so as to prevent cracking and other deformation of the outer wall. However, the method makes it more difficult to dry the outer peripheral part. In the case where the honeycomb formed body has a thin outer wall and partition walls and a large percent opening (i.e., poor strength of the honeycomb formed body), wrinkles and dents in the outer periphery, warpage of partition walls, and other deformation are difficult to prevent, which is problematic.

Patent Document 1: Japanese Patent Application Laid-Open (kokai) No. 2002-283330

DISCLOSURE OF THE INVENTION

In the case where a honeycomb formed body, which is generally in the cylinder form, is dried by means of electromagnetic waves (high-frequency waves), the inner part of the structure is dried more rapidly than the outer peripheral wall (outer part) thereof. The reason why the above difference in drying speed is provided is as follows. When electromagnetic wave drying is performed, the honeycomb formed body is rapidly heated, in contrast to the case of thermal drying such as hot air drying. During evaporation of water, the temperature of the formed body reaches an equilibrium at about 100° C. When drying is performed only through high-frequency heating, the inside temperature of a drying apparatus is generally lower than the drying formed body. Therefore, releasing of heat from a part of the formed body in the vicinity of the outer peripheral wall thereof, which is in contact with the atmosphere in the drying apparatus, is promoted, resulting in temperature drop of the part, whereby vaporization of water in the part is suppressed. Thus, in order to uniformly dry the entirety of the honeycomb formed body, the inside temperature of the drying apparatus must be regulated to a temperature almost equivalent to that of the drying honeycomb formed body, and the inside humidity must be relatively lowered, during drying, whereby drying of the outer peripheral wall is promoted. In addition, essentially, hot air is applied to the outer peripheral wall so as to locally heat the outer peripheral wall part and remove water vapor residing in the vicinity of the outer peripheral wall, thereby lowering humidity around the outer peripheral wall.

The present invention has been conceived in order to solve the aforementioned problems, and objects of the invention are to provide a method and an apparatus for drying a honeycomb formed body which prevent deformation such as warpage of partition walls of a honeycomb formed body during drying thereof.

In order to attain the aforementioned objects, the present invention provides methods and apparatuses for drying a honeycomb formed body as follows.

[1] A method for drying a honeycomb formed body including subjecting, to high-frequency heating through electromagnetic wave irradiation, a honeycomb formed body in an undried state (i.e., undried honeycomb formed body) which is formed from a raw material composition containing a ceramic raw material and water and which has a plurality of cells defined by partition walls, in a drying space of a humidified and heated atmosphere, whereby water is vaporized from an inner part and an outer part of the undried honeycomb formed bodies so as to dry the undried honeycomb formed body, thereby producing a dried honeycomb formed body, wherein the humidified and heated atmosphere in the drying space is maintained at a humidity level as low as 30 to 65% and a temperature of 75 to 130° C. through feeding water vapor into and forcedly discharging the drying space; and the undried honeycomb formed body is subjected to high-frequency heating in the atmosphere through electromagnetic wave irradiation such that 50 to 99 mass % of water contained in the formed body is evaporated at the end of high-frequency heating, whereby the amount of water vaporized from the outer part of the undried honeycomb formed body, which amount is smaller than that of water vaporized from the inner part of the formed body through high-frequency heating alone, is increased, thereby reducing a difference between amount of water vaporized from the inner part of the undried honeycomb formed body and that of water vaporized from the outer part thereof as well as reducing a difference between drying degree of the inner part of the undried honeycomb formed body and that of the outer part thereof, thereby producing a dried honeycomb formed body in which deformation of the partition walls caused by the difference between drying degree of the inner part and that of the outer part is suppressed (first mode of the honeycomb formed body drying method of the present invention).

[2] A method for drying a honeycomb formed body as described in [1], wherein, after drying of the honeycomb formed body through high-frequency heating, the honeycomb formed body is further dried through application of hot air thereto.

[3] A method for drying a honeycomb formed body as described in [2], wherein the hot air has a temperature of 100 to 130° C.

[4] A method for drying a honeycomb formed body as described in any of [1] to [3], wherein the electromagnetic wave has a frequency of 900 to 10,000 MHz.

[5] A method for drying a honeycomb formed body as described in any of [1] to [4], wherein the honeycomb formed body has a percent cell opening of 80% or more, and each of the partition walls has a thickness of 0.18 mm or less.

[6] A method for drying a honeycomb formed body including subjecting, to high-frequency heating through electromagnetic wave irradiation, a honeycomb formed body in an undried state (i.e., undried honeycomb formed body) which is formed from a raw material composition containing a ceramic raw material and water and which has a plurality of cells defined by partition walls, in a drying space of a humidified and heated atmosphere, whereby water is vaporized from an inner part and an outer part of the undried honeycomb formed bodies so as to dry the undried honeycomb formed body, thereby producing a dried honeycomb formed body, wherein the undried honeycomb formed body is subjected to high-frequency heating in the atmosphere through electromagnetic wave irradiation such that 50 to 99 mass % of water contained in the formed body is evaporated at the end of high-frequency heating, while the humidified and heated atmosphere in the drying space is maintained at a humidity level as low as 30 to 65% and a temperature of 75 to 130° C.; and hot air is fed into the drying space so as to apply the hot air to the undried honeycomb formed body, whereby the amount of water vaporized from the outer part of the undried honeycomb formed body, which amount is smaller than that of water vaporized from the inner part of the formed body through high-frequency heating alone, is increased, thereby reducing a difference between amount of water vaporized from the inner part of the undried honeycomb formed body and that of water vaporized from the outer part thereof as well as reducing a difference between drying degree of the inner part of the undried honeycomb formed body and that of the outer part thereof, thereby producing a dried honeycomb formed body in which deformation of the partition walls caused by the difference between drying degree of the inner part and that of the outer part is suppressed (second mode of the honeycomb formed body drying method of the present invention).

[7] A method for drying a honeycomb formed body as described in [6], wherein hot air is fed into the drying space at a velocity of 0.5 to 10 m/s and a flow rate of 3 to 60 $m^3$/s.

[8] A method for drying a honeycomb formed body as described in [6] or [7], wherein the hot air fed into the drying space has a temperature of 80 to 135° C.

[9] A method for drying a honeycomb formed body as described in any of [6] to [8], wherein the hot air fed into the drying space has a humidity level of 20% or less.

[10] A method for drying a honeycomb formed body as described in any of [6] to [9], wherein the honeycomb formed body is dried in the drying space while the structure is rotated about the center axis thereof.

[11] A method for drying a honeycomb formed body as described in any of [6] to [10], wherein, in addition to the hot air fed into the drying space, hot air (second hot air) is further applied to an outer peripheral wall of the undried honeycomb formed body at a predetermined distance from the wall, to thereby dry the undried honeycomb formed body.

[12] A method for drying a honeycomb formed body as described in [11], wherein the second hot air applied to the outer peripheral wall of the undried honeycomb formed body has a velocity of 0.5 to 10 m/s.

[13] A method for drying a honeycomb formed body as described in [11] or [12], wherein the second hot air applied to the outer peripheral wall of the undried honeycomb formed body has a temperature of 80 to 135° C.

[14] A method for drying a honeycomb formed body as described in any of [11] to [13], wherein the second hot air applied to the outer peripheral wall of the undried honeycomb formed body has a humidity level of 20% or less.

[15] A method for drying a honeycomb formed body as described in any of [6] to [14], wherein the humidity and temperature of the drying space are controlled through feeding hot air into and forcedly discharging the drying space.

[16] A method for drying a honeycomb formed body as described in any of [6] to [15], wherein after drying of the honeycomb formed body through high-frequency heating, the honeycomb formed body is further dried through application of hot air (hot air for post-drying) thereto.

[17] A method for drying a honeycomb formed body as described in [16], wherein the hot air for post-drying has a temperature of 100 to 130° C.

[18] A method for drying a honeycomb formed body as described in any of [6] to [17], wherein the electromagnetic wave has a frequency of 900 to 10,000 MHz.

[19] A method for drying a honeycomb formed body as described in any of [6] to [18], wherein the honeycomb formed body has a percent cell opening of 80% or more, and each of the partition walls has a thickness of 0.18 mm or less.

[20] An apparatus for drying a honeycomb formed body, in use, which is capable of performing subjecting, to high-frequency heating through electromagnetic wave irradiation, a honeycomb formed body in an undried state (i.e., undried honeycomb formed body) which is formed from a raw material composition containing a ceramic raw material and water and which has a plurality of cells defined by partition walls, in a drying space of a humidified and heated atmosphere, whereby water is vaporized from an inner part and an outer part of the undried honeycomb formed bodies so as to dry the undried honeycomb formed body, thereby producing a dried honeycomb formed body, the apparatus comprising a drying chamber having a drying space for accommodating the undried honeycomb formed body in a humidified and heated atmosphere; an electromagnetic wave generator for generating the electromagnetic wave with which the undried honeycomb formed body accommodated in the drying chamber is to be irradiated such that 50 to 99 mass % of water contained in the undried formed body is evaporated at the end of irradiation; and an atmosphere controlling unit having a water vapor feeding means and a forced discharge means and allowing the humidified and heated atmosphere in the drying space to maintain at a humidity level as low as 30 to 65% and a temperature of 75 to 130° C., wherein the undried honeycomb formed body accommodated in the drying chamber in which the humidified and heated atmosphere is maintained by means of the atmosphere controlling unit is irradiated with an electromagnetic wave generated by the electromagnetic wave generator, whereby the amount of water vaporized from the outer part of the undried honeycomb formed body, which amount is smaller than that of water vaporized from the inner part of the formed body through high-frequency heating alone, is increased, thereby reducing a difference between amount of water vaporized from the inner part of the undried honeycomb formed body and that of water vaporized from the outer part thereof as well as reducing a difference between drying degree of the inner part of the undried honeycomb formed body and that of the outer part thereof, thereby producing a dried honeycomb formed body in which deformation of the partition walls caused by the difference between drying degree of the inner part and that of the outer part is suppressed (first mode of the honeycomb formed body drying apparatus of the present invention).

[21] An apparatus for drying a honeycomb formed body as described in [20], wherein the drying chamber has a heat insulating material covering the same.

[22] An apparatus for drying a honeycomb formed body as described in [20] or [21], wherein the electromagnetic wave has a frequency of 900 to 10,000 MHz.

[23] An apparatus for drying a honeycomb formed body as described in any of [20] to [22], which further comprises a hot air drying chamber having a hot air drying space for accommodating the honeycomb formed body which has been dried in the drying space included in the drying chamber wherein the honeycomb formed body is further dried through application of hot air thereto in the hot air drying space, and a hot air generator for generating the hot air.

[24] An apparatus for drying a honeycomb formed body as described in [23], wherein the hot air has a temperature of 100 to 130° C.

[25] An apparatus for drying a honeycomb formed body as described in any of [20] to [24], wherein the honeycomb formed body has a percent cell opening of 80% or more, and each of the partition walls has a thickness of 0.18 mm or less.

[26] An apparatus for drying a honeycomb formed body, in use, which is capable of performing subjecting, to high-frequency heating through electromagnetic wave irradiation, a honeycomb formed body in an undried state (i.e., undried honeycomb formed body) which is formed from a raw material composition containing a ceramic raw material and water and which has a plurality of cells defined by partition walls, in a drying space of a humidified and heated atmosphere, whereby water is vaporized from an inner part and an outer part of the undried honeycomb formed bodies so as to dry the undried honeycomb formed body, thereby producing a dried honeycomb formed body, the apparatus comprising a drying chamber having a drying space for accommodating the undried honeycomb formed body in a humidified and heated atmosphere; an electromagnetic wave generator for generating the electromagnetic wave with which the undried honeycomb formed body accommodated in the drying chamber is to be irradiated for high-frequency heating thereof; and a hot air feeding unit for feeding hot air into the drying chamber, which hot air feeding unit being provided so that the amount of water vaporized from the outer part of the undried honeycomb formed body, which amount is smaller than that of water vaporized from the inner part of the formed body through high-frequency heating alone, is increased synergistic with the high-frequency heating performed by means of the electromagnetic wave generator, such that 50 to 99 mass % of water contained in the undried formed body is evaporated at the end of irradiation, and the humidified and heated atmosphere in the drying space is maintain at a humidity level as low as 30 to 65% and a temperature of 75 to 130° C., wherein the undried honeycomb formed body accommodated in the drying chamber in which the humidified and heated atmosphere is maintained by means of the hot air feeding unit is irradiated with an electromagnetic wave generated by the electromagnetic wave generator, thereby performing high-frequency heating, and the hot air fed by the hot air feeding unit is applied to the undried honeycomb formed body, thereby increasing the amount of water vaporized from the outer part, thereby reducing a difference between amount of water vaporized from the inner part of the undried honeycomb formed body and that of water vaporized from the outer part thereof as well as reducing a difference between drying degree of the inner part of the undried honeycomb formed body and that of the outer part thereof, thereby producing a dried honeycomb formed body in which deformation of the partition walls caused by the difference between drying degree of the inner part and that of the outer part is suppressed (second mode of the honeycomb formed body drying apparatus of the present invention).

[27] An apparatus for drying a honeycomb formed body as described in [26], wherein the hot air feeding unit has a hot air generator and a hot air introduction member for introducing, into the drying chamber, the hot air generated by means of the hot air generator.

[28] An apparatus for drying a honeycomb formed body as described in [26] or [27], wherein hot air is fed by means of the hot air feeding unit at a velocity of 0.5 to 10 m/s and a flow rate of 3 to 60 $m^3$/s.

[29] An apparatus for drying a honeycomb formed body as described in any of [26] to [28], wherein the hot air fed by means of the hot air feeding unit has a temperature of 80 to 135° C.

[30] An apparatus for drying a honeycomb formed body as described in any of [26] to [29], wherein the hot air fed by means of the hot air feeding unit has a humidity level of 20% or less.

[31] An apparatus for drying a honeycomb formed body as described in any of [26] to [30], which further comprises a hot air application apparatus for further applying hot air (second hot air) to an outer peripheral wall of the undried honeycomb formed body accommodated in the drying chamber at a predetermined distance from the wall, to thereby heat the undried honeycomb formed body.

[32] An apparatus for drying a honeycomb formed body as described in [31], wherein the hot air application apparatus has a second hot air application section for applying a second hot air; and the second hot air application section is formed such that the second hot air is applied to the outer peripheral wall in two directions opposing each other and being normal to the center axis of the undried honeycomb formed body, whereby the second hot air is applied to the undried honeycomb formed body in two directions so as to sandwich the outer peripheral wall.

[33] An apparatus for drying a honeycomb formed body as described in [31] or [32], wherein the second hot air is applied by means of the hot air application apparatus to the outer peripheral wall of the undried honeycomb formed body at a velocity of 0.5 to 10 m/s.

[34] An apparatus for drying a honeycomb formed body as described in any of [31] to [33], wherein the second hot air applied by means of the hot air application apparatus to the outer wall of the undried honeycomb formed body has a temperature of 80 to 135° C.

[35] An apparatus for drying a honeycomb formed body as described in any of [31] to [34], wherein the second hot air applied by means of the hot air application apparatus to the outer wall of the undried honeycomb formed body has a humidity level of 20% or less.

[36] An apparatus for drying a honeycomb formed body as described in any of [26] to [35], which further comprises a stand having a rotatable receiving member and a support for rotatably supporting the receiving member, the receiving member being capable of rotating the undried honeycomb formed body placed on an upper surface thereof virtually about the center axis of the receiving member, wherein the undried honeycomb formed body is placed on the receiving member of the stand during drying of the undried honeycomb formed body in the drying chamber;

the undried honeycomb formed body and the stand are transferred into the drying chamber;

the undried honeycomb formed body is dried while the undried honeycomb formed body is rotated through rotation of the receiving member, to thereby provide a dried honeycomb formed body; and the dried honeycomb formed body and the stand are removed from the drying chamber.

[37] An apparatus for drying a honeycomb formed body as described in [36], wherein the receiving member forming the stand has a pinion part for allowing the receiving member to rotate about the center axis;

the drying chamber further contains a conveyer and a rod-like rack part provided along the conveyer, the conveyer being adapted such that the undried honeycomb formed body placed on the stand is placed thereon and transferred to the drying chamber; the undried honeycomb formed body is dried while being transferred, to thereby provide a dried honeycomb formed body; and the dried honeycomb formed body is removed from the drying chamber, and the rod-like rack part being disposed along the conveyer, being aligned in the longitudinal direction of the conveyer, and having rack part teeth formed on one side facing the stand and along the conveyer such that the rack part teeth are engaged with the pinion part of the receiving member during transfer of the undried honeycomb formed body placed on the stand by means of the conveyer, wherein, during transfer of the undried honeycomb formed body placed on the stand by means of the conveyer in the drying chamber, the stand is transferred while the rack part teeth are engaged with the pinion part of the receiving member, thereby rotating the receiving member about the center axis thereof, whereby the undried honeycomb formed body placed on the stand is transferred in the drying chamber while rotating virtually about the center axis of the receiving member.

[38] An apparatus for drying a honeycomb formed body as described in any of [26] to [37], wherein the drying chamber has a heat insulating material covering the same.

[39] An apparatus for drying a honeycomb formed body as described in any of [26] to [38], wherein the electromagnetic wave has a frequency of 900 to 10,000 MHz.

[40] An apparatus for drying a honeycomb formed body as described in any of [26] to [39], which further comprises a post-drying chamber having a post-drying space for accommodating the honeycomb formed body which has been dried in the drying space included in the drying chamber wherein the honeycomb formed body is further dried through application of hot air (for post-drying) thereto, and a post-drying hot air generator for generating the hot air for post-drying.

[41] An apparatus for drying a honeycomb formed body as described in [40], wherein the hot air for post-drying generated by means of the post-drying hot air generator has a temperature of 100 to 130° C.

[429] An apparatus for drying a honeycomb formed body as described in any of [26] to [41], wherein the honeycomb formed body has a percent cell opening of 80% or more, and each of the partition walls has a thickness of 0.18 mm or less.

In the first mode of the honeycomb formed body drying method of the present invention, an undried honeycomb formed body which is formed from a raw material composition containing a ceramic raw material and water is irradiated with an electromagnetic wave for high-frequency heating in a predetermined space whose inside atmosphere has been controlled to a humidity level as low as 30 to 65% and a temperature of 75 to 130° C. through feeding of water vapor and forcedly discharging the inside atmosphere, to thereby dry the undried honeycomb formed bodies such that 50 to 99 mass % of water contained in the formed body is evaporated. Therefore, the amount of water vaporized from the outer part of the undried honeycomb formed body, which amount is smaller than that of water vaporized from the inner part of the formed body through high-frequency heating alone, is increased through employment of the aforementioned humidified and heated atmosphere, thereby reducing a difference between amount of water vaporized from the inner part of the undried honeycomb formed body and that of water vaporized from the outer part thereof as well as reducing a difference between drying degree of the inner part of the undried honeycomb formed body and that of the outer part thereof, thereby suppressing deformation of the partition walls caused by the difference between drying degree of the inner part and that of the outer part.

In the second mode of the honeycomb formed body drying method of the present invention, an undried honeycomb formed body which is formed from a raw material composition containing a ceramic raw material and water is irradiated with an electromagnetic wave for high-frequency heating in a predetermined space whose inside atmosphere has been controlled to a humidity level as low as 30 to 65% and a temperature of 75 to 130° C., and hot air is fed into the aforementioned predetermined space, to thereby dry the undried honeycomb formed bodies such that 50 to 99 mass % of water contained in the formed body is evaporated. Therefore, the amount of water vaporized from the outer part of the undried honeycomb formed body, which amount is smaller than that of water vaporized from the inner part of the formed body through high-frequency heating alone, is increased through employment of the aforementioned humidified and heated atmosphere and feeding the hot air, thereby reducing a difference between amount of water vaporized from the inner part of the undried honeycomb formed body and that of water vaporized from the outer part thereof as well as reducing a difference between drying degree of the inner part of the undried honeycomb formed body and that of the outer part thereof, thereby suppressing deformation of the partition walls caused by the difference between drying degree of the inner part and that of the outer part.

In the first mode of the honeycomb formed body drying apparatus of the present invention, the drying space of the drying chamber is maintained at a humidity level as low as 30 to 65% and a temperature of 75 to 130° C. through an atmosphere controlling unit for feeding water vapor into and forcedly discharging the drying space; and the undried honeycomb formed body placed in the drying space is irradiated with an electromagnetic waver generated by an electromagnetic wave generator for high-frequency heating in the atmosphere such that 50 to 99 mass % of water contained in the formed body is evaporated at the end of high-frequency heating, to thereby dry the undried honeycomb formed body. Therefore, the amount of water vaporized from the outer part of the undried honeycomb formed body, which amount is smaller than that of water vaporized from the inner part of the formed body through high-frequency heating alone, is increased through employment of the aforementioned humidified and heated atmosphere, thereby reducing a difference between amount of water vaporized from the inner part of the undried honeycomb formed body and that of water vaporized from the outer part thereof, thereby producing a dried honeycomb formed body in which deformation of the partition walls caused by a difference between drying degree of the inner part and that of the outer part is suppressed.

In the second mode of the honeycomb formed body drying apparatus of the present invention, the drying space of the drying chamber is maintained at a humidity level as low as 30 to 65% and a temperature of 75 to 130° C. through a hot air feeding unit; and the undried honeycomb formed body is irradiated with an electromagnetic waver generated by an electromagnetic wave generator for high-frequency heating in the atmosphere such that 50 to 99 mass % of water contained in the formed body is evaporated at the end of high-frequency heating, and the hot air generated by the hot air generator is applied to the undried honeycomb molded unit, to thereby dry the undried honeycomb formed body. Therefore, the amount of water vaporized from the outer part of the undried honeycomb formed body, which amount is smaller than that of water vaporized from the inner part of the formed body through high-frequency heating alone, is increased through employment of the aforementioned humidified and heated atmosphere and application of hot air, thereby reducing a difference between amount of water vaporized from the inner part of the undried honeycomb formed body and that of water vaporized from the outer part thereof as well as reducing a difference between drying degree of the inner part of the undried honeycomb formed body and that of the outer part thereof, thereby producing a dried honeycomb formed body in which deformation of the partition walls caused by the difference between drying degree of the inner part and that of the outer part is suppressed.

DESCRIPTION OF REFERENCE NUMERALS

Figure 1:
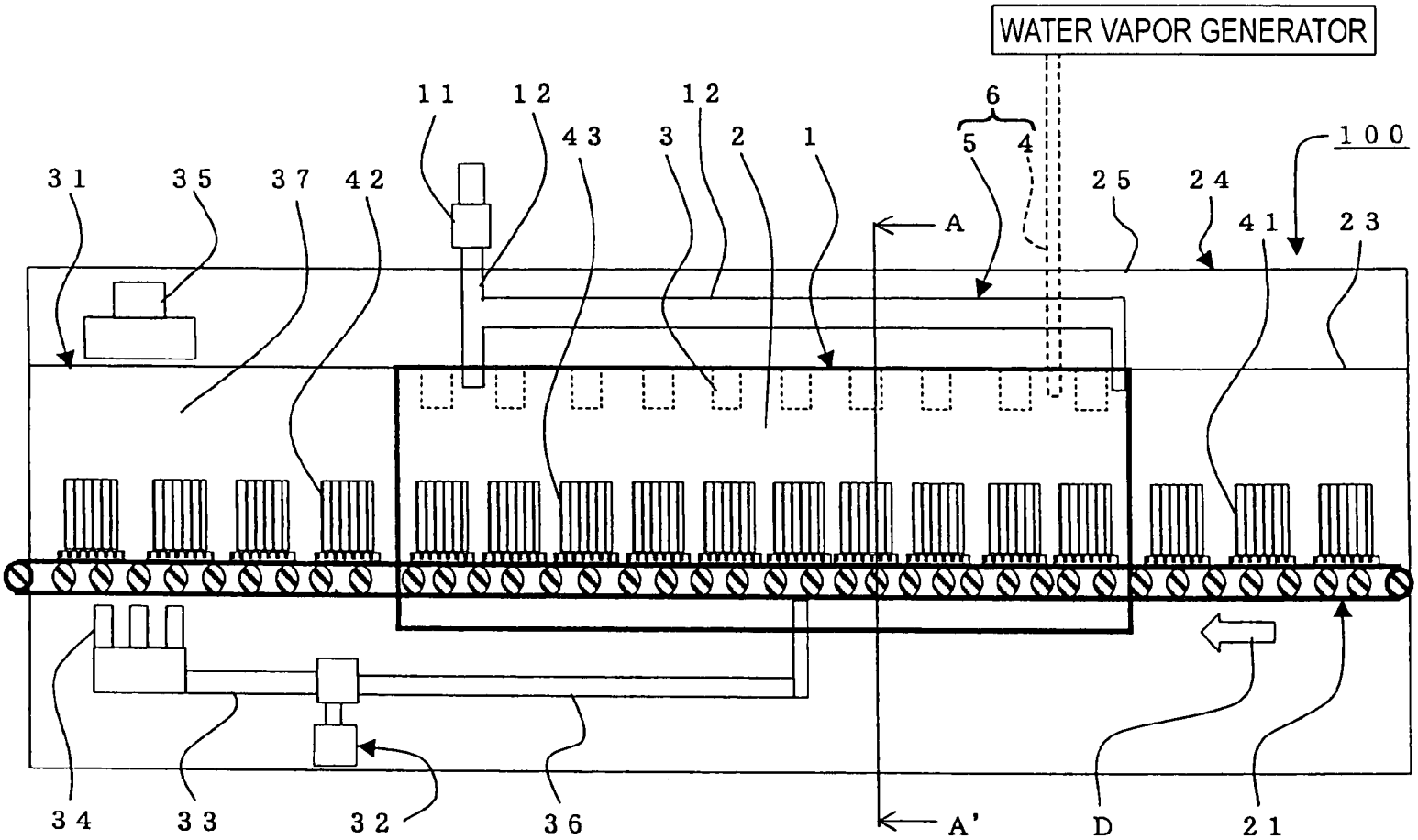
FIG. 1 A schematic cross-sectional view of a honeycomb formed body drying apparatus employed in an embodiment according to a first mode of the honeycomb formed body drying method of the present invention.

1, 51, 101, and 151 • • • drying chamber; 2, 52, 102, and 152 • • • drying space; 3, 53, 103, and 153 • • • electromagnetic wave generator; 4 and 54 • • • water vapor feeding means; 104 and 154 • • • hot air generator; 5 and 55 • • • forced discharge means; 105 and 155 • • • hot air introducing member; 6 and 56 • • • atmosphere controlling unit; 106 and 156 • • • hot air feeding unit; 11, 61, 111, and 161 • • • blower for forced discharge; 12, 62, 112, and 162 • • • duct for forced discharge; 113 and 163 • • • forced discharge means; 21, 71, 121, and 171 • • • conveyer; 23, 73, 123, and 173 • • • ceiling; 24, 74, 124, and 174 • • • outer frame; 25, 75, 125, and 175 • • • roof; 26, 76, 126, and 176 • • • side surface; 127 and 177 • • • rack part; 128 and 178 • • • hot air application apparatus; 129 and 179 • • • rack part teeth; 31 and 81 • • • hot air drying chamber; 131 and 181 • • • post-drying chamber; 32 and 82 • • • hot air generator; 132 and 182 • • • hot air generator for post-drying; 33, 83, 133, and 183 • • • hot air feeding piping; 34, 84, 134, and 184 • • • hot air feeding nozzle; 35, 85, 135, and 185 • • • hot air discharge duct; 36, 86, 136, and 186 • • • piping for preliminary heating; 37 and 87 • • • hot air drying space; 137, 187 • • • post-drying space; 41, 91, 141, and 191 • • • undried honeycomb formed body; 42, 92, 142, and 192 • • • dried honeycomb formed body; 43 and 93 • • • honeycomb formed body in drying; 44, 94, 144, and 194 • • • outer peripheral surface wall; 45, 95, 145, and 195 • • • top end; 146 and 196 • • • support; 147 and 197 • • • receiving member; 148 and 198 • • • stand; 149 and 199 • • • pinion part; 100, 200, 300, and 400 • • • drying apparatus; D, E, DD, and EE • • • honeycomb formed body moving direction; H,h • • • second hot air; and R and S • • • rotational direction.

BEST MODES FOR CARRYING OUT THE INVENTION

Best modes for Carrying Out the present invention (hereinafter may be referred to as "embodiment") will next be described with reference to the drawings. However, these embodiments should not be construed as limiting the invention thereto. It is also understood by those skilled in the art that appropriate changes and modifications in arrangement of the embodiments may be made in the invention without departing from the scope of the present invention. In the drawings, the same reference numerals denote components common to each of the drawings.

Best modes for Carrying Out the present invention (hereinafter may be referred to as "embodiment") will next be described with reference to the drawings. However, these embodiments should not be construed as limiting the invention thereto. It is also understood by those skilled in the art that appropriate changes and modifications in arrangement of the embodiments may be made in the invention without departing from the scope of the present invention. In the drawings, the same reference numerals denote components common to each of the drawings.

FIG. 1 is a schematic cross-sectional view of an apparatus for drying a honeycomb formed body employed in an embodiment according to a first mode of the honeycomb formed body drying method of the present invention.

The embodiment of the first mode of the honeycomb formed body drying method of the present invention can be carried out by means of a honeycomb formed body drying apparatus 100 (hereinafter may be referred to simply as "drying apparatus 100") shown in FIG. 1. However, the drying apparatus to be employed in the embodiment of the first mode of the honeycomb formed body drying method of the present invention is not limited to the drying apparatus 100 shown in FIG. 1.

Through employment of the drying apparatus 100 shown in FIG. 1, a honeycomb formed body in an undried state (i.e., undried honeycomb formed body) 41 which is formed from a raw material composition containing a ceramic raw material and water and which has a plurality of cells defined by partition walls is subjected to high-frequency heating through electromagnetic wave irradiation, whereby water is vaporized from an inner part and an outer part of the undried honeycomb formed body 41 so as to dry the undried honeycomb formed body 41, thereby producing a dried honeycomb formed body 41. As used herein, when the undried honeycomb formed body 41 assumes a cylinder, the term "an outer part of the undried honeycomb formed body 41" refers to a part in the vicinity of the outer peripheral surface wall of the cylinder. The outer part represents an area about 20-mm inside from the outermost periphery when viewed in a cross-section of the cylinder. The term "an inner part of the undried honeycomb formed body 41" refers to a part other than the outer part, and the inner part includes a center axis. When the undried honeycomb formed body 41 assumes a shape other than a cylinder, the inner part refers to a part in the vicinity of the center axis or the center, and the outer part refers to a part in the vicinity of the outer periphery or the outer surface. In this case, the outer part represents an area about 20-mm inside from the outer periphery (outer surface), and the inner part of the undried honeycomb formed body 41 is a part other than the outer part.

The drying apparatus 100 includes, in a cylindrical outer frame 24, a drying chamber 1 having a drying space 2 for accommodating an undried honeycomb formed body 41 in a humidified and heated atmosphere; an electromagnetic wave generator 3 for generating an electromagnetic wave with which the undried honeycomb formed body 41 accommodated in the drying chamber 1 is to be irradiated such that 50 to 99 mass % of water contained in the undried formed body 41 is evaporated at the end of irradiation; and an atmosphere controlling unit 6 having a water vapor feeding means 4 and a forced discharge means 5 and allowing the humidified and heated atmosphere in the drying chamber 1 to maintain at a humidity level as low as 30 to 65% and a temperature of 75 to 130° C.

The outer frame 24 forming the drying apparatus 100 is formed in a cylindrical shape such that the center axis is oriented virtually in the horizontal direction. An undried honeycomb formed body 41 is transferred into the drying apparatus through one end of the cylinder, and the dried honeycomb formed body 42 is removed through the other end thereof. In the outer frame 24, a ceiling 23 is disposed virtually in the horizontal direction so as to provide a space between the ceiling and a roof 25 of the outer frame, and divides the outer frame 24 into two chambers. The drying chamber 1 is formed into a cylinder, and the center axis of the cylinder virtually aligns the center axis of the outer frame 24. The drying chamber is disposed under (in the vertical direction) the roof 25 formed in the outer frame 24. In the drying chamber 100, a conveyer 21 is disposed so as to extend from one end (inlet end) of the outer frame 24 to the other end (outlet end) of the outer frame 24 through the inside of the cylindrical drying chamber 1 so that the undried honeycomb formed bodies 41 are continuously transferred into the chamber and the thus-dried honeycomb formed bodies 42 are continuously removed to the outside. No particular limitation is imposed on the type of the conveyer 21, and a belt conveyer, a roller conveyer, and other conveyers may be employed.

The embodiment of the honeycomb formed body drying method is carried out through employment of the drying apparatus 100. Specifically, an undried honeycomb formed body 41 is subjected to high-frequency heating through electromagnetic wave irradiation in a drying space 2 of a humidified and heated atmosphere, whereby water is vaporized from an inner part and an outer part of the undried honeycomb formed body 41 so as to dry the undried honeycomb formed body 41, thereby producing a dried honeycomb formed body 42.

In the embodiment of the honeycomb formed body drying method, the humidified and heated atmosphere in the drying space 2 is maintained at a humidity level as low as 30 to 65% and a temperature of 75 to 130° C. by means of an atmosphere controlling unit 6, and the undried honeycomb formed body 41 is subjected to high-frequency heating in the atmosphere through an electromagnetic wave generated by an electromagnetic wave generator 3 such that 50 to 99 mass % of water contained in the formed body 41 is evaporated at the end of high-frequency heating, whereby the amount of water vaporized from the outer part of the undried honeycomb formed body 41, which amount is smaller than that of water vaporized from the inner part of the formed body 41 through high-frequency heating alone, is increased through employment of the aforementioned predetermined humidified and heated atmosphere, thereby reducing a difference between amount of water vaporized from the inner part of the undried honeycomb formed body 41 and that of water vaporized from the outer part thereof as well as reducing a difference between drying degree of the inner part of the undried honeycomb formed body 41 and that of the outer part thereof, thereby producing a dried honeycomb formed body in which deformation of the partition walls caused by the difference between drying degree of the inner part and that of the outer part is suppressed.

Deformation of the partition walls caused by the difference between drying degree of the inner part and that of the outer part occurs by the following mechanism. During drying of the undried honeycomb formed body 41, partition walls are shrunken. If the honeycomb formed body is not dried uniformly, difference in shrinkage degree of partition walls is provided. The difference causes warpage. Thus, deformation of partition walls such as warpage occurs. In the embodiment of the honeycomb formed body drying method, such deformation of partition walls can be prevented. The term "deformation of partition walls" is used to refer to warpage of partition walls, generation of wrinkles, generation of wrinkles in the outermost peripheral surface wall, formation of dents, etc.

When the humidity level in the drying space 2 is lower than 30%, an outer peripheral surface wall 44 (see FIG. 2) of the undried honeycomb formed body 41 is dried excessively rapidly. Thus, defects are generated in the outer peripheral surface wall 44, which is problematic. A humidity level in the drying space of higher than 65% is also problematic. Specifically, the amount of water vaporized from the outer part of the undried honeycomb formed body 41 is generally smaller than that of vaporized from the inner part at an initial drying stage, providing a difference in drying degree between the inner part and the outer part, resulting in deformation of partition walls such as wrinkles. When the humidity level is excessively high, the difference in drying degree between the inner part and the outer part increases, resulting in deformation of partition walls, which is problematic. As used herein, the term "defects in the outer peripheral surface wall" refers to a cracking of the outer peripheral surface wall having a length corresponding to 20% or more the thickness. In addition, when the humidity level is high, the amount of water vaporized from the undried honeycomb formed body problematically decreases due to loss of the energy of the input electromagnetic wave. Therefore, the humidity level in the drying space 2 is more preferably 30 to 50%.

When the inside temperature of the drying space 2 is lower than 75° C., the undried honeycomb formed body 41 is difficult to dry, resulting in problematic wrinkles in the outer peripheral surface wall, whereas when the temperature is higher than 130° C., substances other than water such as an organic binder contained in the undried honeycomb formed body 41 are vaporized, leading to deformation of partition walls of the undried honeycomb formed body 41, and the organic binder may be burnt. Needless to say, both cases are problematic. Thus, the inside temperature of the drying space 2 is preferably 90 to 110° C. When the inside temperature falls within a range of 75 to 90° C., the produced honeycomb formed bodies have no problem in quality. However, difference in water content between the inner part of the honeycomb formed body and the outer part thereof as low as less than 10 mass % may result. In addition, a longer drying time may be required so as to compensate drop in drying efficiency.

When the percent vaporized water amount of the undried honeycomb formed body is less than 50 mass %, shrinkage of the honeycomb formed body is not complete. When water is further vaporized, the honeycomb formed body further shrinks not uniformly, resulting in deformation of partition walls of the honeycomb formed body, which is problematic. When the percent vaporized water amount of the undried honeycomb formed body is more than 99 mass %, the honeycomb formed body is over dried locally, and scorching may occur due to burning of a binder, which is also problematic. As used herein, the term "percent vaporized water amount of the undried honeycomb formed body" refers to a value obtained by dividing the mass of vaporized water by the mass of water contained in the undried honeycomb formed body and multiplying 100.

In the embodiment of the honeycomb formed body drying method, when the undried honeycomb formed body 42 is dried by means of the drying apparatus 100, the following procedure is employed. Firstly, the undried honeycomb formed body 41 is transferred into the chamber through one end of the outer frame 24 and placed on the conveyer 21. The undried honeycomb formed body 41 is conveyed through driving force of the conveyer 21 so as to move in the honeycomb formed body conveyance direction D, followed by transferring into the drying chamber 1 through one end of the drying chamber 1 by means of the conveyer 21. While the undried honeycomb formed body 41 is conveyed by means of the conveyer 21 in the drying chamber 1 as a honeycomb formed body 43 in a drying state, the undried honeycomb formed body 41 is subjected to high-frequency heating for drying through irradiation with an electromagnetic wave generated by the electromagnetic wave generator 3 in the drying space 2 of which atmosphere is controlled to a predetermined humidity and temperature by means of the atmosphere controlling unit 6, to thereby form the dried honeycomb formed body 42. Subsequently, the thus-dried honeycomb formed body 42 is removed from the drying chamber 1 through the other end thereof and transferred to a hot air drying chamber 31. The dried honeycomb formed body 42 is conveyed by means of the conveyer 21 in the hot air drying chamber 31, while further dried through application of hot air to the formed body 42. Subsequently, the formed body 42 is removed from the hot air drying chamber 31 and the drying apparatus 100.

As shown in FIG. 1, the drying apparatus 100 includes the atmosphere controlling unit 6 for controlling the drying space 2 in the drying chamber 1 to a predetermined humidity and temperature. The atmosphere controlling unit 6 has a water vapor feeding means 4 for feeding water vapor into the drying chamber 1, and a forced discharge means 5 for discharging the drying chamber 1. The water vapor feeding means 4 is a piping having at the tip nozzles through which water vapor is discharged, and the tip is inserted in the drying chamber 1. Water vapor to be employed is generated by means of, for example, a water vapor generator and fed through the piping. In the forced discharge means 5, the piping connected to a blower for forced discharge 11 is branched into two. The tip of one branch is inserted into the space near one end of the drying chamber 1, and the tip of the other branch is inserted into a space near the other end of the drying chamber 1. The gas present in the drying chamber 1 is discharged by means of the blower for forced discharge 11 to the outside in accordance with need through the piping.

The water vapor that is fed through the water vapor feeding means 4 into the drying chamber 1 preferably has a temperature of 100 to 120° C. The amount of water vapor fed into the drying chamber 1 and the amount of discharge from the drying chamber 1 to the outside through the blower for forced discharge 11 are appropriately determined in accordance with factors such as the capacity of the drying chamber 1, and the number and dimensions of honeycomb formed bodies accommodated in the drying chamber 1. For example, when the capacity of the drying chamber 1 is about 7 $m^3$, the amount of water vapor is preferably 90 to 120 kg/Hr, and the discharge rate is preferably 20 to 50 $m^3$/min.

Figure 2:
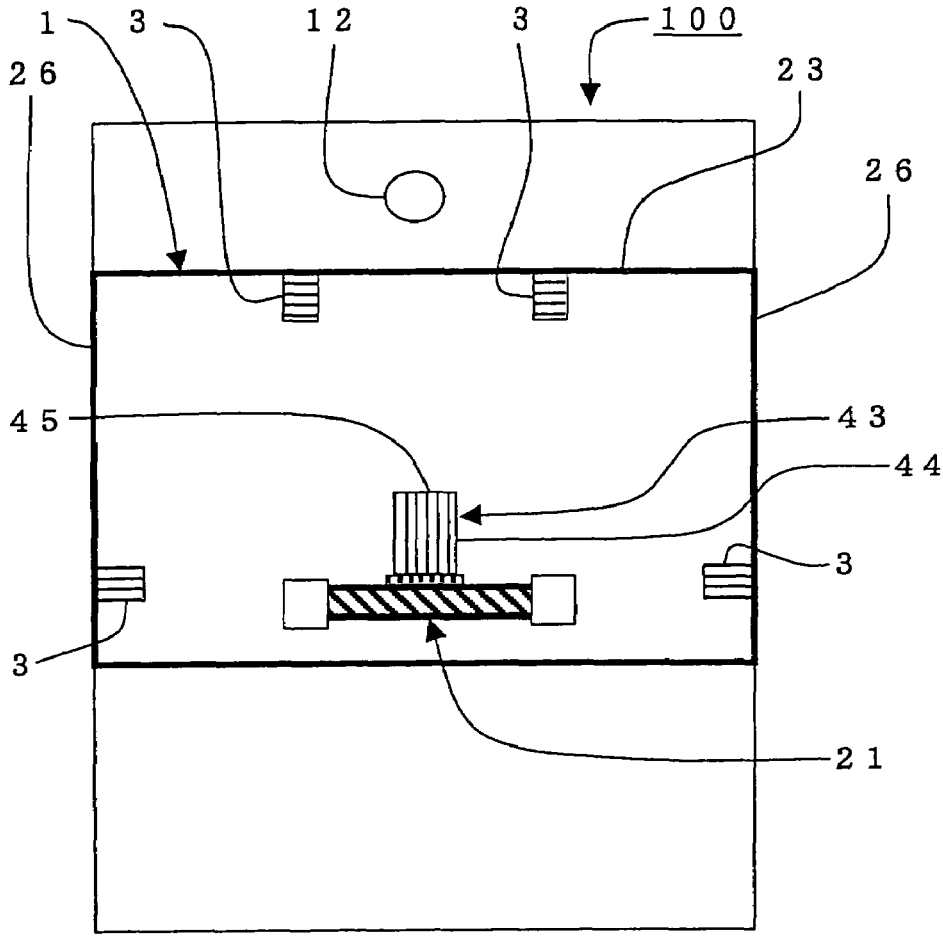
FIG. 2 A cross-section taken along line A-A' in FIG. 1.

As shown in FIG. 1, electromagnetic wave generators 3 are disposed on the inner surface of the ceiling 23 of the drying chamber 1 along the center axis of the outer frame 24. The electromagnetic wave generators 3 are distributed in ten zones located with virtually the same intervals. In each zone, as shown in FIG. 2, two electromagnetic wave generators are disposed on the ceiling 23 and one electromagnetic wave generator on each side surface 26; i.e., total four electromagnetic wave generators 3 are disposed. Thus, 40 electromagnetic wave generators 3 are disposed in the drying chamber 1.

FIG. 2 is a cross-section taken along line A-A' in FIG. 1. According to the embodiment of the honeycomb formed body drying method, the drying honeycomb formed body 43 is irradiated with an electromagnetic wave of the outer peripheral surface wall 44 side and the top end 45 side. Thus, the inside of the honeycomb formed body is more uniformly irradiated with an electromagnetic wave, and the entirety of the honeycomb formed body more uniformly undergoes high-frequency heating, which is preferred. No particular limitation is imposed on the place and number of the electromagnetic wave generators 3 to be disposed. For example, in each zone, one electromagnetic wave generator 3 may be placed at any place. Alternatively, five or more electromagnetic wave generators 3 may be disposed at any places. The number of the zones where an electromagnetic wave generator 3 is disposed is not limited to ten, and may be appropriately determined in accordance with factors such as the length of the drying chamber 1. Preferably, the drying chamber 1 is covered with a heat insulating material, whereby the inside temperature of the drying chamber 1 is maintained. In addition, the outer frame 24 is preferably surrounded by a heat insulating material.

In the embodiment of the honeycomb formed body drying method, the electromagnetic wave employed for drying preferably has a frequency of 900 to 10,000 MHz, more preferably 2,000 to 10,000 MHz. When the frequency is lower than 900 MHz, water is difficult to undergo high-frequency heating, and a honeycomb formed body may be difficult to dry. In contrast, when the frequency is higher than 2,000 MHz, water effectively undergoes high-frequency heating. As shown in FIG. 2, the electromagnetic wave generators 3 may be disposed inside the drying chamber 1. Alternatively, electromagnetic wave generators 3 may be disposed outside the drying chamber 1, and the generated electromagnetic wave is guided through a predetermined site of the drying chamber 1 into the drying chamber 1 via a waveguide so as to apply the electromagnetic wave to the drying honeycomb formed body 43.

The energy of the electromagnetic wave applied to the honeycomb formed body is appropriately determined in accordance with factors such as the capacity of the drying chamber 1, and the number and dimensions of honeycomb formed bodies accommodated in the drying chamber 1. For example, when the capacity of the drying chamber 1 is about 7 $m^3$, the total energy is preferably 150 to 300 kW. When the energy is smaller than 150 kW, the honeycomb formed body may fail to be dried to a predetermined drying degree, whereas when the energy is higher than 300 kW, the vaporization speed of water from the honeycomb formed body is elevated, difficulty may be encountered in reduction of the difference in drying condition between the inner part of the honeycomb formed body and the outer part thereof, even though the drying space is heated and humidified.

In the embodiment of the honeycomb formed body drying method, as mentioned above, preferably, an undried honeycomb formed body is dried through electromagnetic wave irradiation to form a dried honeycomb formed body, and hot air is applied to the dried honeycomb formed body for further drying. Through this procedure, the remaining water content can be reduced to 0.5% or lower. In a preferred manner for applying hot air to the dried honeycomb formed body for further drying, as shown in FIG. 1, the dried honeycomb formed body 42 is transferred by means of a conveyer to a hot air drying chamber 31 having a hot air drying space 37 and provided in the vicinity of the outlet of the outer frame 24. The hot air fed through hot air feeding nozzles 34 disposed under the hot air drying chamber 31 is applied to the dried honeycomb formed body 42 in the direction from the bottom to the top end. The hot air fed through hot air feeding nozzles 34 to the hot air drying chamber 31 is discharged to the outside through a hot air discharge duct 35 disposed above the hot air drying chamber 31 (space between the ceiling 23 and the roof 25). The aforementioned hot air preferably has a temperature of 100 to 130° C. When the temperature is lower than 100° C., the dried honeycomb formed body may be difficult to dry, whereas when the temperature is higher than 130° C., substances other than water such as an organic binder contained in the undried honeycomb formed body 41 are vaporized, causing deformation of partition walls of the undried honeycomb formed body 41 and burning of the organic binder and other substances, which are problematic.

The hot air feeding nozzles 34 are linked to the hot air generator 32 via the hot air feeding piping 33 so that the hot air generated by the hot air generator 32 is transferred via the hot air feeding piping 33 and discharged through the hot air feeding nozzles 34. No particular limitation is imposed on the type of the hot air generator 32 so long as the generator attains predetermined temperature and flow rate. For example, a hot air generator having a heater employing high-temperature water vapor or an electric heater and a blower may be used. In the generator, a blow generated by the blower is heated to provide hot air. The hot air generated by the hot air generator 32 may be used for preliminarily heating the unheated drying chamber 1 before the start of electromagnetic wave drying of the undried honeycomb formed body. In FIG. 1, hot air is fed into the drying chamber 1 via a piping for preliminary heating 36 connected to the hot air generator 32.

The embodiment of the honeycomb formed body drying method is suitable for drying a honeycomb formed body made of ceramic material, having a percent opening of 80% or more and a partition wall thickness of 0.18 mm or less. As used herein, the term "percent opening" refers to a ratio (percent) of the total cross-sectional area of the cell through-holes to the cross-sectional area of the honeycomb formed body in which the cell through-holes are located, as viewed in a cross-section of a honeycomb formed body cut in a direction normal to the center axis.

The drying apparatus employed in the embodiment of the honeycomb formed body drying method continuously dries honeycomb formed bodies and may be a batch-type. In use, the batch-type drying apparatus is such that a predetermined number of undried honeycomb formed bodies are accommodated therein and irradiated with an electromagnetic wave to thereby dry the honeycomb formed bodies; irradiation of the electromagnetic wave is stopped; the thus-dried honeycomb formed bodies are removed; another predetermined number of undried honeycomb formed bodies are accommodated therein; and irradiation of an electromagnetic wave is started.

Figure 3:
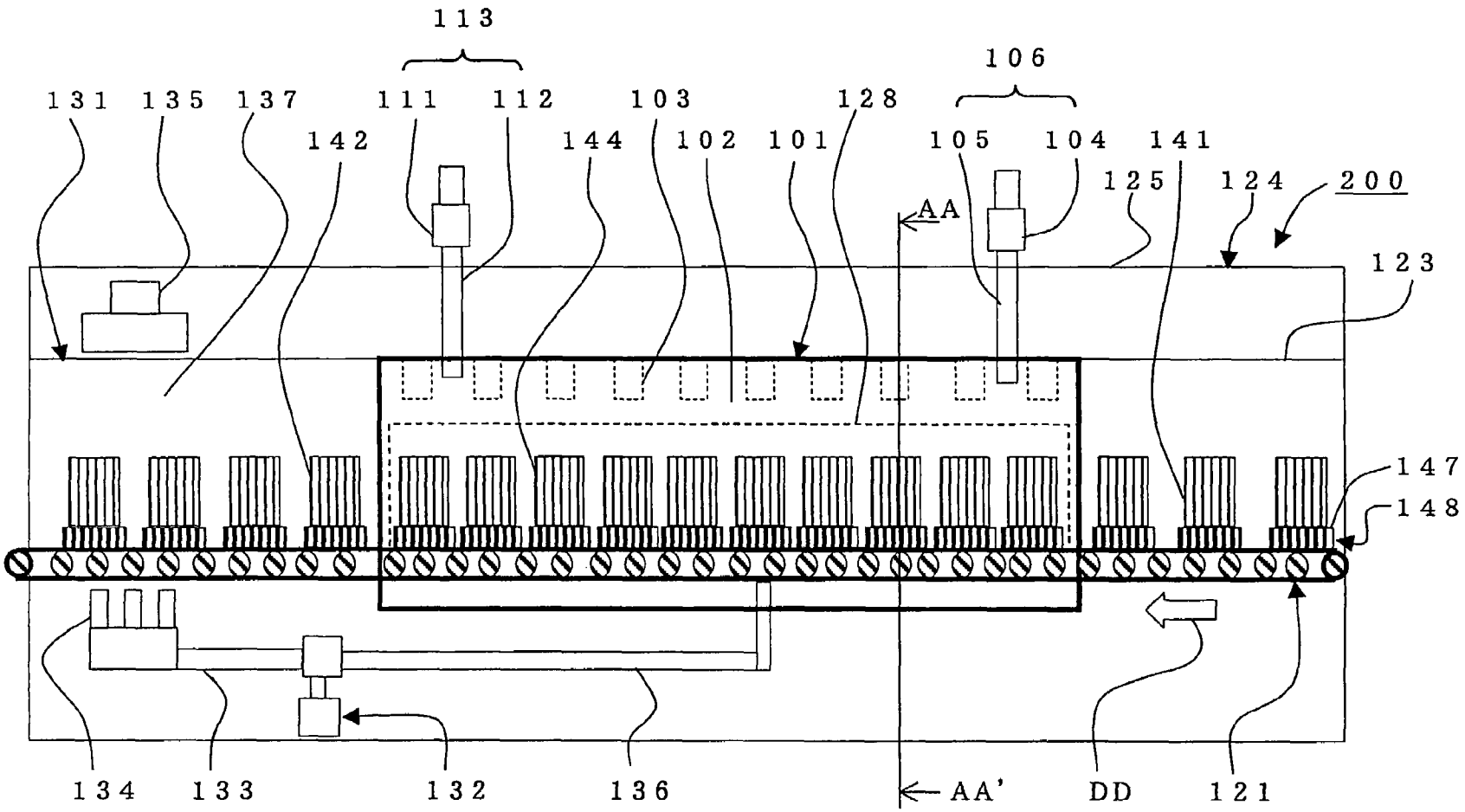
FIG. 3 A schematic cross-sectional view of an apparatus for drying a honeycomb formed body employed in an embodiment according to a second mode of the method of the present invention for drying a honeycomb formed body.

FIG. 3 is a schematic cross-sectional view of an apparatus for drying a honeycomb formed body employed in an embodiment according to a second mode of the honeycomb formed body drying method of the present invention.

The embodiment of the second mode of the honeycomb formed body drying method of the present invention can be carried out by means of a honeycomb formed body drying apparatus 200 (hereinafter may be referred to simply as "drying apparatus 200") shown in FIG. 3. However, the drying apparatus to be employed in the embodiment of the second mode of the honeycomb formed body drying method of the present invention is not limited to the drying apparatus 200 shown in FIG. 3.

Through employment of the drying apparatus 200 shown in FIG. 3, a honeycomb formed body in an undried state (i.e., undried honeycomb formed body) 141 which is formed from a raw material composition containing a ceramic raw material and water and which has a plurality of cells defined by partition walls is subjected to high-frequency heating through electromagnetic wave irradiation, whereby water is vaporized from an inner part and an outer part of the undried honeycomb formed body 141 so as to dry the undried honeycomb formed body 141, thereby producing a dried honeycomb formed body 142. As used herein, when the undried honeycomb formed body 141 assumes a cylinder, the term "an outer part of the undried honeycomb formed body 141" refers to a part in the vicinity of the outer peripheral surface wall of the cylinder. The outer part represents an area about 20-mm inside from the outermost periphery when viewed in a cross-section of the cylinder. The term "an inner part of the undried honeycomb formed body 141" refers to a part other than the outer part, and the inner part includes a center axis. When the undried honeycomb formed body 141 assumes a shape other than a cylinder, the inner part refers to a part in the vicinity of the center axis or the center, and the outer part refers to a part in the vicinity of the outer periphery or the outer surface. In this case, the outer part represents an area about 20-mm inside from the outer periphery (outer surface), and the inner part of the undried honeycomb formed body 141 is a part other than the outer part.

The drying apparatus 200 includes, in a cylindrical outer frame 124, a drying chamber 101 having a drying space 102 for accommodating an undried honeycomb formed body 141 in a humidified and heated atmosphere; an electromagnetic wave generator 103 for generating an electromagnetic wave with which the undried honeycomb formed body 141 accommodated in the drying chamber 101 is to be irradiated for performing high-frequency heating of the undried honeycomb formed body 141; a hot air feeding unit 106 for feeding hot air into the drying space, which hot air feeding unit being provided so that the amount of water vaporized from the outer part of the undried honeycomb formed body 141, which amount is smaller than that of water vaporized from the inner part of the formed body through high-frequency heating alone, is increased synergistic with the high-frequency heating performed by means of the electromagnetic wave generator 103, such that 50 to 99 mass % of water contained in the undried formed body 141 is evaporated at the end of irradiation, and the humidified and heated atmosphere in the drying space 102 is maintain at a humidity level as low as 30 to 65% and a temperature of 75 to 130° C.; and a hot air application apparatus 128 for applying hot air for heating to the outer peripheral surface wall of the undried honeycomb formed body 141 accommodated in the drying chamber 101.

The outer frame 124 forming the drying apparatus 200 is formed in a cylindrical shape such that the center axis is oriented virtually in the horizontal direction. An undried honeycomb formed body 141 is transferred into the drying apparatus through one end of the cylinder, and the dried honeycomb formed body 142 is removed through the other end thereof. In the outer frame 124, a ceiling 123 is disposed virtually in the horizontal direction so as to provide a space between the ceiling and a roof 125 of the outer frame, and divides the outer frame 124 into two chambers. The drying chamber 101 is formed into a cylinder, and the center axis of the cylinder virtually aligns the center axis of the outer frame 124. The drying chamber is disposed under (in the vertical direction) the roof 125 formed in the outer frame 124.

In the drying chamber 200, a conveyer 121 is disposed so as to extend from one end (inlet end) of the outer frame 124 to the other end (outlet end) of the outer frame 124 through the inside of the cylindrical drying chamber 101 so that the undried honeycomb formed bodies 141 are continuously transferred into the chamber and the thus-dried honeycomb formed bodies 142 are continuously removed to the outside.

In the vicinity of the inlet end of the drying chamber 101 for transferring the undried honeycomb formed bodies 141, there is provided a hot air feeding unit 106 having a hot air generator 104 for generating hot air and a hot air introducing member 105 for feeding hot air generated by the hot air generator 104 into the drying space 102 of the drying chamber 101. The hot air fed into the drying space 102 through the hot air feeding unit 106 is applied to the undried honeycomb formed body 141 transferred into the drying space 102, thereby drying the undried honeycomb formed body 141.

In the vicinity of the outlet end of the drying chamber 101 for removing the undried honeycomb formed bodies 141, there is provided a forced discharge means 113 having a blower for forced discharge 111 and a duct for forced discharge 112, through which means the drying space 102 is discharged.

In the drying chamber 101, a hot air application apparatus 128 is disposed so as to sandwich the conveyer 121 along the direction DD of transferring the undried honeycomb formed body 141. The hot air application apparatus 128 has a second hot air application section (not illustrated) for applying hot air (second hot air). The second hot air application section (not illustrated) is formed such that the second hot air is applied to the outer peripheral wall 144 in two directions opposing each other and being normal to the center axis of the undried honeycomb formed body 141, whereby the second hot air is applied to the undried honeycomb formed body 141 in two directions so as to sandwich the outer peripheral wall 144. Preferably, the second blow application section has a plurality of tubular nozzles (hot air application nozzles), through which hot air is applied to the outer peripheral surface wall 144 of the undried honeycomb formed body 141. More preferably, the hot air application nozzles are aligned along the center axis (top to bottom) of the undried honeycomb formed body 141, while the axis of each hot air application nozzle is aligned in the horizontal direction and the tip of the nozzle faces the outer peripheral surface wall 144, whereby the second hot airs are simultaneously applied to the outer peripheral surface wall 144 from the top end to the bottom thereof. In this case, preferably, the line passing through the nozzle tips is virtually aligned in the center axis of the undried honeycomb formed body 141. Through employment of the configuration, the second hot air can be applied to the entire outer peripheral surface wall 144 during movement of the undried honeycomb formed body 141. Preferably, a plurality of sets of nozzles being aligned in the center axis of the undried honeycomb formed body 141 are arranged in the direction DD of transferring the undried honeycomb formed body 141 such that the nozzle lines are arranged virtually in parallel one another, whereby second hot airs provided by the nozzle sets are sequentially applied to the outer peripheral surface wall 144 during transfer of the undried honeycomb formed body 141. However, the nozzles in each nozzle set are not necessarily in the same line, and a zigzag or an irregular arrangement may also be employed, so long as the second hot air can be applied to the outer peripheral surface wall 144 uniformly from the top end to the bottom thereof. The second hot air application section does not necessarily have hot air application nozzles and, instead, may have a piping having a plurality of holes through which the hot air is applied.

The embodiment of the honeycomb formed body drying method is carried out through employment of the drying apparatus 200. Specifically, an undried honeycomb formed body 141 is subjected to high-frequency heating through electromagnetic wave irradiation in a drying space 102 which is maintained at a humidified and heated atmosphere through hot air, and the supplied hot air is applied to the undried honeycomb formed body 141, whereby water is vaporized from an inner part and an outer part of the undried honeycomb formed body 141 so as to dry the undried honeycomb formed body 141, thereby producing a dried honeycomb formed body 142.

In the embodiment of the honeycomb formed body drying method, the humidified and heated atmosphere in the drying space 102 is maintained at a humidity level as low as 30 to 65% and a temperature of 75 to 130° C. by means of a hot air feeding unit 106, and the undried honeycomb formed body 141 is subjected to high-frequency heating in the atmosphere through an electromagnetic wave generated by an electromagnetic wave generator 103 and also, the hot air fed through the hot air feeding unit 106 is applied to the undried honeycomb formed body 141, such that 50 to 99 mass % of water contained in the formed body 141 is evaporated at the end of high-frequency heating, whereby the amount of water vaporized from the outer part of the undried honeycomb formed body 141, which amount is smaller than that of water vaporized from the inner part of the formed body 141 through high-frequency heating alone, is increased through employment of the aforementioned predetermined humidified and heated atmosphere and application of hot air to the formed body 141, thereby reducing a difference between amount of water vaporized from the inner part of the undried honeycomb formed body 141 and that of water vaporized from the outer part thereof as well as reducing a difference between drying degree of the inner part of the undried honeycomb formed body 141 and that of the outer part thereof, thereby producing a dried honeycomb formed body in which deformation of the partition walls caused by the difference between drying degree of the inner part and that of the outer part is suppressed. In addition to the hot air fed by means of the hot air feeding unit 106, hot air (second hot air) is applied to the outer peripheral surface wall 144 of the undried honeycomb formed body 141 at a predetermined distance from the wall, to thereby further reduce a difference between drying degree of the inner part of the undried honeycomb formed body 141 and that of the outer part thereof, thereby further suppressing deformation of the partition walls caused by the difference between drying degree of the inner part and that of the outer part. In order to promote drying of the outer part, which is difficult to dry through sole high-frequency, and to control the drying state to that of the inner part, which is readily dried through sole heating high-frequency heating, preferably, application of the second hot air applied to the outer peripheral surface wall 144 of the undried honeycomb formed body 141 is carried out only to the outer peripheral surface wall 144 of the undried honeycomb formed body 141 and not to the top end and the bottom thereof. If the second hot air is applied to the top end and the bottom, the difference in the amount of water vaporization between the inner part of the undried honeycomb formed body 141 and the outer part thereof may be difficult to reduce.

Deformation of the partition walls caused by the difference between drying degree of the inner part and that of the outer part occurs by the following mechanism. During drying of the undried honeycomb formed body 141, partition walls are shrunken. If the honeycomb formed body is not dried uniformly, difference in shrinkage degree of partition walls is provided. The difference causes warpage. Thus, deformation of partition walls such as warpage occurs. In the embodiment of the honeycomb formed body drying method, such deformation of partition walls can be prevented. The term "deformation of partition walls" is used to refer to warpage of partition walls, generation of wrinkles, generation of wrinkles in the outermost peripheral surface wall, formation of dents, etc.

When the humidity level in the drying space 102 is lower than 30%, an outer peripheral surface wall 144 of the undried honeycomb formed body 141 is dried excessively rapidly. Thus, defects are generated in the outer peripheral surface wall 144, which is problematic. A humidity level in the drying space of higher than 65% is also problematic. Specifically, the amount of water vaporized from the outer part of the undried honeycomb formed body 141 is generally smaller than that of vaporized from the inner part at an initial drying stage, providing a difference in drying degree between the inner part and the outer part, resulting in deformation of partition walls such as wrinkles. When the humidity level is excessively high, the difference in drying degree between the inner part and the outer part increases, resulting in deformation of partition walls, which is problematic. As used herein, the term "defects in the outer peripheral surface wall" refers to a cracking of the outer peripheral surface wall having a length corresponding to 20% or more the thickness. In addition, when the humidity level is high, the amount of water vaporized from the undried honeycomb formed body problematically decreases due to loss of the energy of the input electromagnetic wave. Therefore, the humidity level in the drying space 2 is more preferably 30 to 50%.

When the inside temperature of the drying space 102 is lower than 75° C., the undried honeycomb formed body 141 is difficult to dry, resulting in problematic wrinkles in the outer peripheral surface wall, whereas when the temperature is higher than 130° C., substances other than water such as an organic binder contained in the undried honeycomb formed body 141 are vaporized, leading to deformation of partition walls of the undried honeycomb formed body 141, and the organic binder may be burnt. Needless to say, both cases are problematic. Thus, the inside temperature of the drying space 102 is preferably 90 to 110° C. When the inside temperature falls within a range of 75 to 90° C., the produced honeycomb formed bodies have no problem in quality. However, difference in water content between the inner part of the honeycomb formed body and the outer part thereof as low as less than 10 mass % may result, and drying of the honeycomb formed body may be slightly insufficient.

When the percent vaporized water amount of the undried honeycomb formed body is less than 50 mass %, shrinkage of the honeycomb formed body is not complete. When water is further vaporized after completion of drying in the drying apparatus 200, the honeycomb formed body further shrinks not uniformly, resulting in deformation of partition walls of the honeycomb formed body, which is problematic. When the percent vaporized water amount of the undried honeycomb formed body is more than 99 mass %, the honeycomb formed body is over dried locally, and scorching may occur due to burning of a binder, which is also problematic. As used herein, the term "percent vaporized water amount of the undried honeycomb formed body" refers to a value obtained by dividing the mass of vaporized water by the mass of water contained in the undried honeycomb formed body and multiplying 100.

The hot air fed through the hot air feeding unit 106 into the drying space 102 preferably has a velocity of 0.5 to 10 m/s, more preferably 2 to 10 m/s, and preferably has a flow rate of 3 to 60 $m^3$/s, more preferably 12 to 60 $m^3$/s. When the velocity is less than 0.5 m/s, heating of the outer part of the undried honeycomb formed body 141 through the hot air may be insufficient, whereas when the velocity is more than 10 m/s, the undried honeycomb formed body 141 may undesirably be moved, or the outer peripheral surface wall 144 may be deformed. When the flow rate is less than 3 $m^3/s$, heating of the outer part of the undried honeycomb formed body 141 through the hot air may be insufficient, whereas when the flow rate is more than 60 $m^3/s$, the undried honeycomb formed body 141 may undesirably be moved, or the outer peripheral surface wall 144 may be deformed.

The hot air fed through the hot air feeding unit 106 into the drying space 102 preferably has a temperature of 80 to 135° C., more preferably 95 to 110° C. When the temperature is lower than 80° C., the effect of promoting vaporization of water from the outer part of the undried honeycomb formed body 141 may be reduced, whereas when the temperature is higher than 135° C., substances other than water such as an organic binder contained in the undried honeycomb formed body 141 are vaporized, leading to deformation of partition walls of the undried honeycomb formed body 141, and the organic binder may be burnt, which are problematic.

The hot air fed through the hot air feeding unit 106 into the drying space 2 preferably has a humidity level of 20% or less, more preferably 15% or less. When the humidity level is higher than 20%, the effect of promoting vaporization of water from the outer part of the undried honeycomb formed body 141 may be reduced.

In the present embodiment, in addition to the aforementioned hot air fed through the hot air feeding unit 106, a second hot air is preferably applied to the outer peripheral surface wall 144 of the undried honeycomb formed body 141 at a predetermined distance from the wall. In this case, the second hot air preferably has a velocity of 0.5 to 10 m/s, more preferably 2 to 10 m/s. When the velocity is less than 0.5 m/s, heating of the outer part of the undried honeycomb formed body 141 through the second hot air may be insufficient, the effect of promoting vaporization of water from the outer peripheral surface wall 144 of the undried honeycomb formed body 141 by virtue of the second hot air may be reduced, the effect being based on blowing out water vapor residing in the vicinity of the outer peripheral surface wall 144 of the undried honeycomb formed body 141, whereby the humidity around the outer peripheral surface wall 144 is reduced. When the velocity is more than 10 m/s, the undried honeycomb formed body 141 may undesirably be moved, or the outer peripheral surface wall 144 may be deformed. Upon application of the second hot air to the outer peripheral surface wall 144 of the undried honeycomb formed body 141, the second hot air is preferably applied to the entire outer peripheral surface wall 144. Thus, the second hot air can be applied to the entire outer peripheral surface wall 144 at the aforementioned predetermined velocity, whereby vaporization of water from the outer peripheral surface wall 144 of the undried honeycomb formed body 141 can be effectively promoted.

The second hot air fed through the hot air application apparatus 128 to the outer peripheral surface wall 144 preferably has a temperature of 80 to 135° C., more preferably 95 to 110° C. When the temperature is lower than 80° C., the effect of promoting vaporization of water from the outer part of the undried honeycomb formed body 141 may be reduced, whereas when the temperature is higher than 135° C., substances other than water such as an organic binder contained in the undried honeycomb formed body 141 are vaporized, leading to deformation of partition walls of the undried honeycomb formed body 141, and the organic binder may be burnt, which are problematic.

The second hot air fed through the hot air application apparatus 128 to the outer peripheral surface wall 144 preferably has a humidity level of 20% or less. When the humidity level is higher than 20%, the effect of promoting vaporization of water from the outer part of the undried honeycomb formed body 141 may be reduced.

The distance between a blow application site of the second hot air application section of the hot air application apparatus 128 and the outer peripheral surface wall 144 of the undried honeycomb formed body 141 (i.e., a predetermined distance from the hot air feeding unit 106 upon application of the second hot air to the outer peripheral surface wall 144) is preferably 0.1 to 1.0 m. When the distance is smaller than 0.1 m, the hot air may be excessively applied to a part of the outer peripheral surface wall 144, whereas when the distance is in excess of 1.0 m, the second hot air which cannot be applied to the outer peripheral surface wall 144 but which is fed to the other sites predominates, possibly reducing the second hot air application efficiency.

In the present embodiment, the aforementioned hot air feeding unit 106 has a hot air generator 104 for generating hot air and a hot air introducing member 105 for feeding hot air generated by the hot air generator 104 into the drying space 102 of the drying chamber 101. No particular limitation is imposed on the type of the hot air generator 104 so long as the generator attains predetermined temperature and flow rate. For example, a hot air generator having a heater employing high-temperature water vapor or an electric heater and a blower may be used. In the generator, a blow generated by the blower is heated to provide hot air. The temperature of the hot air low may be controlled basically by means of the above heater, and the humidity thereof may be controlled by means of a demoisturizer or a similar device.

As shown in FIG. 3, the tubular nozzle of the hot air introducing member 105 may be inserted into the drying chamber 101. Alternatively, the drying chamber 101 may be provided with a hole; the hot air generated by the hot air generator 104 is transferred to the hole through a piping; and the hot air is introduced into the drying chamber 101 through the hole. When the nozzle is inserted into the drying chamber 101, the nozzle is preferably oriented in a desired direction.

In the embodiment of the honeycomb formed body drying method, when the undried honeycomb formed body 142 is dried by means of the drying apparatus 200, the following procedure is employed. Firstly, the undried honeycomb formed body 141 placed on a stand 148 is transferred into the chamber through one end of the outer frame 124 and placed on the conveyer 121. The undried honeycomb formed body 141 is conveyed through driving force of the conveyer 121 so as to move in the honeycomb formed body conveyance direction DD, followed by transferring into the drying chamber 101 through one end of the drying chamber 101 by means of the conveyer 121. While the undried honeycomb formed body 141 is conveyed by means of the conveyer 121 in the drying chamber 101, the undried honeycomb formed body 141 is subjected to high-frequency heating for drying through irradiation with an electromagnetic wave generated by the electromagnetic wave generator 103 in the drying space 102 of a predetermined humidity and temperature, and the hot air fed through the hot air feeding unit 106 is applied to the honeycomb formed body. In addition, the second hot air is applied to the outer peripheral wall 144 through the hot air application apparatus 128 so as to promote drying the outer part, to thereby form the dried honeycomb formed body 142 of which entirety is almost uniformly dried. Subsequently, the thus-dried honeycomb formed body 142 is removed from the drying chamber 101 through the other end thereof and transferred to a post-drying chamber 131. The dried honeycomb formed body 142 is conveyed by means of the conveyer 121 in the post-drying chamber 131, while further dried through application of hot air to the formed body 142. Subsequently, the formed body 142 is removed from the post-drying chamber 131 and the drying apparatus 200.

In the embodiment of the honeycomb formed body drying method, preferably, hot air is applied to the outer peripheral surface wall 144 of the undried honeycomb formed body 141 in the drying space 102, while the undried honeycomb formed body 141 is rotated about the center axis thereof. Since hot air is applied to the undried honeycomb formed body 141 in a rotating state, the hot air is uniformly applied to the entire outer peripheral surface wall 141, which is preferred. For the similar reason, preferably, the second hot air is applied to the undried honeycomb formed body 141 in a rotating state.

Figure 4:
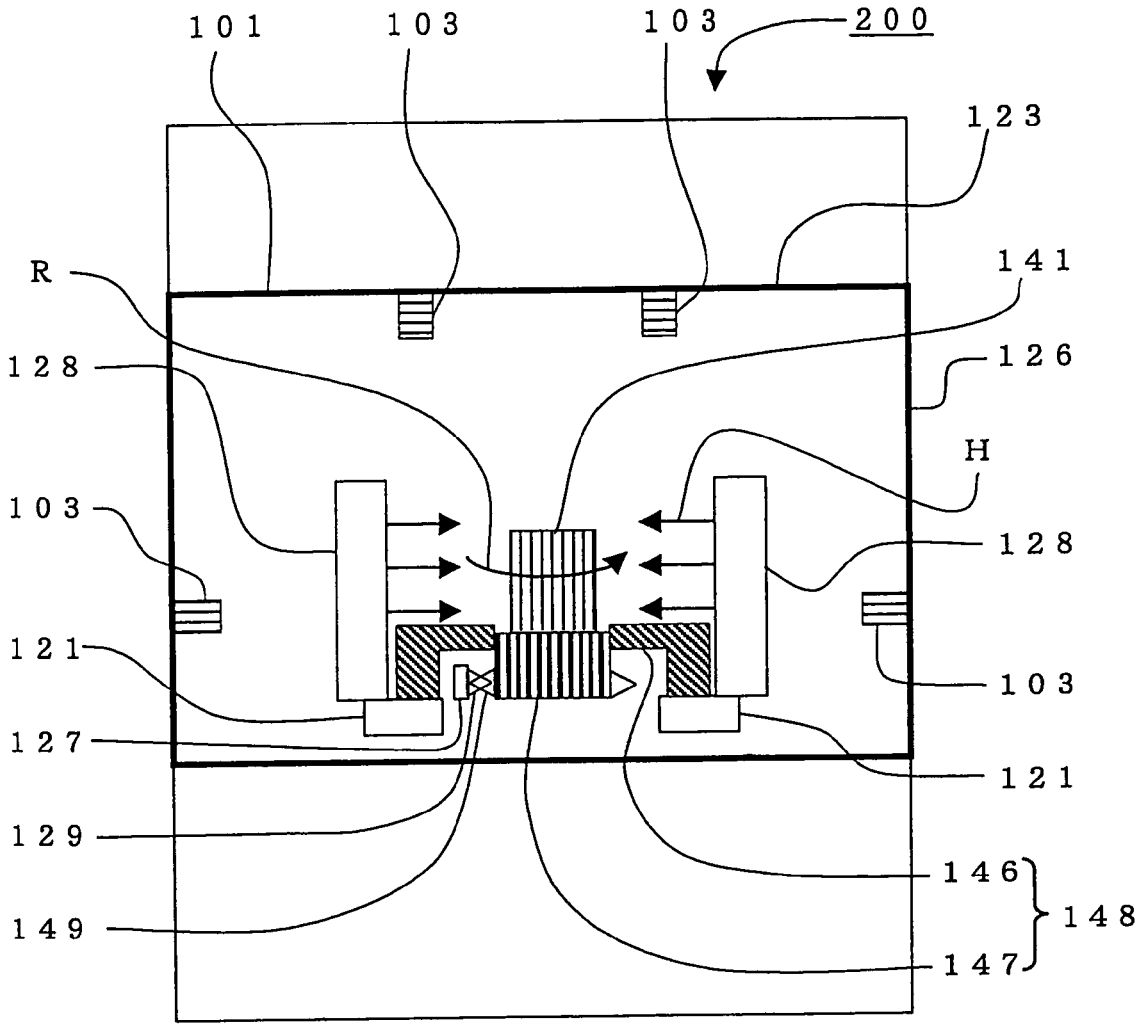
FIG. 4 A cross-section taken along line AA-AA' in FIG. 3.

A preferred embodiment of the method for rotating the undried honeycomb formed body 141 will be described with reference to FIG. 4. The stand 148 is configured to have a rotatable receiving member 147 and a support 146 for rotatably supporting the receiving member 147, the receiving member 147 being capable of rotating the undried honeycomb formed body 141 placed on an upper surface thereof virtually about the center axis of the receiving member 147. The receiving member 147 forming the stand 148 is provided so as to have a pinion part 149 for allowing the receiving member 147 to rotate about the center axis. A rod-like rack part 127 is disposed along a conveyer 121, which is aligned in the longitudinal direction of the conveyer 121 and has rack part teeth 129 formed on one side facing the stand 148 and along the conveyer 121 such that the rack part teeth 129 are engaged with the pinion part 149 of the receiving member 147 during transfer of the undried honeycomb formed body 141 placed on the stand 148 by means of the conveyer 121. During transfer of the undried honeycomb formed body 141 placed on the stand 148 by means of the conveyer 121 in the drying chamber 101, the stand 148 is transferred while the rack part teeth 129 are engaged with the pinion part 149 of the receiving member 147, thereby rotating the receiving member 147 about the center axis thereof, whereby the undried honeycomb formed body 141 placed on the stand 148 is transferred in the drying apparatus 200 while rotating virtually about the center axis of the receiving member 147. According to the above method, the energy used to move the undried honeycomb formed body 141 partially serves as a driving source for rotating the undried honeycomb formed body 141. Therefore, an additional driving source is not required, which is preferred. FIG. 4 is a cross-section taken along line AA-AA' in FIG. 3.

Figure 5:
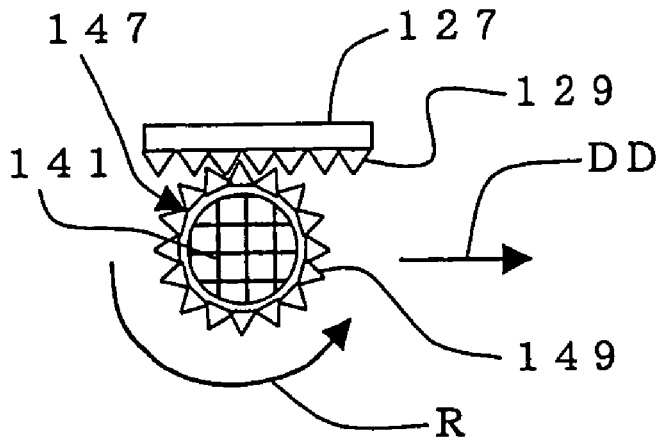
FIG. 5 A schematic plan view showing that the receiving member of the stand on which an undried honeycomb formed body is placed is rotated by means of the rack part.

FIG. 5 is a schematic plan view showing that the receiving member 147 of the stand on which the undried honeycomb formed body 141 is placed is rotated by means of the rack part 127. As shown in FIG. 5 and mentioned above, the mechanism for rotating the undried honeycomb formed body 141 involves transferring of the stand in the DD direction while the pinion part 149 of the receiving member 147 is engaged with the rack part teeth 129 of the rack part 127 affixed to the inside of the drying chamber; rotating the receiving member 147 about the center axis thereof in a rotational direction R; and rotating the undried honeycomb formed body 141 placed on the stand virtually about the center axis of the receiving member in the rotational direction R.

Figure 6:
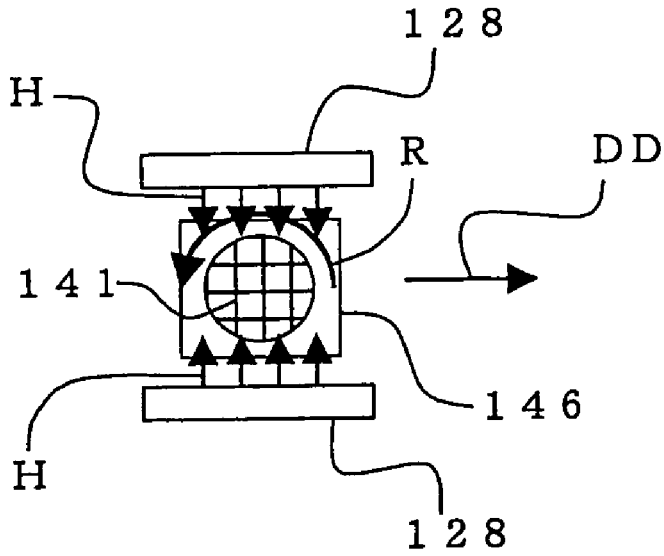
FIG. 6 A schematic plan view showing that hot air is applied to an undried honeycomb formed body which is rotating.

As shown in FIG. 6, the undried honeycomb formed body 141 is transferred in the direction DD while being supported by means of the support 146 of the stand and rotating in the rotational direction R. Preferably, a second hot air H is applied to the undried honeycomb formed body 141 in two directions so as to sandwich the structure by means of the hot air application apparatus 128 disposed so as to be aligned the direction DD and sandwich the undried honeycomb formed body 141. FIG. 6 is a schematic plan view showing that a second hot air is applied to the undried honeycomb formed body 141 which is rotating.

Although the aforementioned combination of the pinion part and the rack part is employed as a mechanism for rotating the undried honeycomb formed body, other methods may also be employed. Examples include a method in which the member on which the undried honeycomb formed body is placed (i.e., receiving member) is directly rotated through a rotational driving system such as a motor; and a method in which a magnet or a like means is buried in the member on which the undried honeycomb formed body is placed (i.e., receiving member) and the member is rotated in a non-contact manner by means of an electromagnetic circuit.

As shown in FIG. 3, the drying apparatus 200 is provided with a hot air feeding unit 106 and an discharge means 113 for discharging the drying chamber 101. In the embodiment of the honeycomb formed body drying method, the drying space 102 of the drying chamber 101 can be controlled to a predetermined humidity and temperature through employment of the hot air feeding unit 106 and the forced discharge means 113. The atmosphere of the drying space 102 may be controlled through adjusting of the properties (i.e., temperature, humidity level, flow rate, and velocity) of the hot air fed through the hot air feeding unit 106. However, combination of the hot air feeding unit 106 and the forced discharge means 113 is preferred, since the atmosphere can be more precisely controlled. In addition, through provision of a water vapor feeding means (not illustrated) for feeding water vapor into the drying space 102, more precise atmosphere control can be realized. The forced discharge means 5 has a blower for forced discharge 111 and a duct for forced discharge 112 connected to the blower for forced discharge 111, and the duct for forced discharge 112 is communicated with the drying chamber 101. The atmosphere of the drying chamber 101 is discharged in accordance with needs through the blower for forced discharge 111 via the duct for forced discharge 112.

In the case where the water vapor that is fed through the water vapor feeding means into the drying chamber 101, the water vapor preferably has a temperature of 100 to 120° C. The amount of water vapor fed into the drying chamber 101 and the amount of discharge from the drying chamber 101 to the outside through the blower for forced discharge 111 are appropriately determined in accordance with factors such as the capacity of the drying chamber 101, and the number and dimensions of honeycomb formed bodies accommodated in the drying chamber 101. For example, when the capacity of the drying chamber 101 is about 7 $m^3$, the amount of water vapor is preferably 90 to 120 kg/Hr, and the discharge rate is preferably 20 to 50 $m^3$/min.

As shown in FIG. 3, electromagnetic wave generators 103 are disposed on the inner surface of the ceiling 123 of the drying chamber 101 along the center axis of the outer frame 124. The electromagnetic wave generators 103 are distributed in ten zones located with virtually the same intervals. In each zone, as shown in FIG. 4, two electromagnetic wave generators are disposed on the ceiling 123 and one electromagnetic wave generator on each side surface 126; i.e., total four electromagnetic wave generators 103 are disposed. Thus, 40 electromagnetic wave generators 103 are disposed in the drying chamber 101. According to the embodiment of the honeycomb formed body drying method, the undried honeycomb formed body 141 is irradiated with an electromagnetic wave of the outer peripheral surface wall 144 side and the top end 145 side. Thus, the inside of the honeycomb formed body is more uniformly irradiated with an electromagnetic wave, and the entirety of the honeycomb formed body more uniformly undergoes high-frequency heating, which is preferred. No particular limitation is imposed on the place and number of the electromagnetic wave generators 103 to be disposed. For example, in each zone, one electromagnetic wave generator 103 may be placed at any place. Alternatively, five or more electromagnetic wave generators 103 may be disposed at any places. The number of the zones where an electromagnetic wave generator 103 is disposed is not limited to ten, and may be appropriately determined in accordance with factors such as the length of the drying chamber 101. Preferably, the drying chamber 101 is covered with a heat insulating material, whereby the inside temperature of the drying chamber 101 is maintained. In addition, the outer frame 124 is preferably surrounded by a heat insulating material.

In the embodiment of the honeycomb formed body drying method, the electromagnetic wave employed for drying preferably has a frequency of 900 to 10,000 MHz, more preferably 2,000 to 10,000 MHz. When the frequency is lower than 900 MHz, water is difficult to undergo high-frequency heating, and a honeycomb formed body may be difficult to dry. In contrast, when the frequency is higher than 2,000 MHz, water effectively undergoes high-frequency heating. As shown in FIG. 4, the electromagnetic wave generators 103 may be disposed inside the drying chamber 101. Alternatively, electromagnetic wave generators 103 may be disposed outside the drying chamber 101, and the generated electromagnetic wave is guided through a predetermined site of the drying chamber 101 into the drying chamber 101 via a waveguide so as to apply the electromagnetic wave to the undried honeycomb formed body 141.

The energy of the electromagnetic wave applied to the honeycomb formed body is appropriately determined in accordance with factors such as the capacity of the drying chamber 101, and the number and dimensions of honeycomb formed bodies accommodated in the drying chamber 101. For example, when the capacity of the drying chamber 1 is about 7 $m^3$, the total energy is preferably 150 to 300 kW. When the energy is smaller than 150 kW, the honeycomb formed body may fail to be dried to a predetermined drying degree, whereas when the energy is higher than 300 kW, the vaporization speed of water from the honeycomb formed body is elevated, difficulty may be encountered in reduction of the difference in drying condition between the inner part of the honeycomb formed body and the outer part thereof, even though the drying space is heated and humidified.

In the embodiment of the honeycomb formed body drying method, as mentioned above, preferably, an undried honeycomb formed body is dried through electromagnetic wave irradiation to form a dried honeycomb formed body, and hot air (hot air for post-drying) is applied to the dried honeycomb formed body for further drying. Through this procedure, the remaining water content can be reduced to 0.5% or lower. In a preferred manner for applying hot air (hot air for post-drying) to the dried honeycomb formed body for further drying, as shown in FIG. 3, the dried honeycomb formed body 142 is transferred by means of a conveyer 121 to a post-drying chamber 131 having a post-drying space 137 and provided in the vicinity of the outlet of the outer frame 124. The hot air for post-drying fed through hot air feeding nozzles 134 disposed under the post-drying chamber 131 is applied to the dried honeycomb formed body 142 in the direction from the bottom to the top end. The hot air fed through hot air feeding nozzles 134 to the post-drying chamber 131 is discharged to the outside through a hot air discharge duct 135 disposed above the post-drying chamber 131 (space between the ceiling 123 and the roof 125). The aforementioned hot air for post-drying preferably has a temperature of 100 to 130° C. When the temperature is lower than 100° C., the dried honeycomb formed body 142 may be difficult to dry, whereas when the temperature is higher than 130° C., substances other than water such as an organic binder contained in the dried honeycomb formed body 142 are vaporized, causing deformation of partition walls of the dried honeycomb formed body 142 and burning of the organic binder and other substances, which are problematic.

The hot air feeding nozzles 134 are linked to the post-drying hot air generator 132 via the hot air feeding piping 133 so that the hot air for post-drying generated by the post-drying hot air generator 132 is transferred via the hot air feeding piping 133 and discharged through the hot air feeding nozzles 134. No particular limitation is imposed on the type of the post-drying hot air generator 132 so long as the generator attains predetermined temperature and flow rate. For example, a hot air generator having a heater employing high-temperature water vapor or an electric heater and a blower may be used. In the generator, a blow generated by the blower is heated to provide hot air. The hot air for post-drying generated by the post-drying hot air generator 132 may be used for preliminarily heating the unheated drying chamber 101 before the start of electromagnetic wave drying of the undried honeycomb formed body. In FIG. 3, hot air is fed into the drying chamber 101 via a piping for preliminary heating 136 connected to the post-drying hot air generator 132.

The embodiment of the honeycomb formed body drying method is suitable for drying a honeycomb formed body made of ceramic material, having a percent opening of 80% or more and a partition wall thickness of 0.18 mm or less. As used herein, the term "percent opening" refers to a ratio (percent) of the total cross-sectional area of the cell through-holes to the cross-sectional area of the honeycomb formed body in which the cell through-holes are located, as viewed in a cross-section of a honeycomb formed body cut in a direction normal to the center axis.

The drying apparatus employed in the embodiment of the honeycomb formed body drying method continuously dries honeycomb formed bodies and may be a batch-type. In use, the batch-type drying apparatus is such that a predetermined number of undried honeycomb formed bodies are accommodated therein and irradiated with an electromagnetic wave to thereby dry the honeycomb formed bodies; irradiation of the electromagnetic wave is stopped; the thus-dried honeycomb formed bodies are removed; another predetermined number of undried honeycomb formed bodies are accommodated therein; and irradiation of an electromagnetic wave is started.

Figure 7:
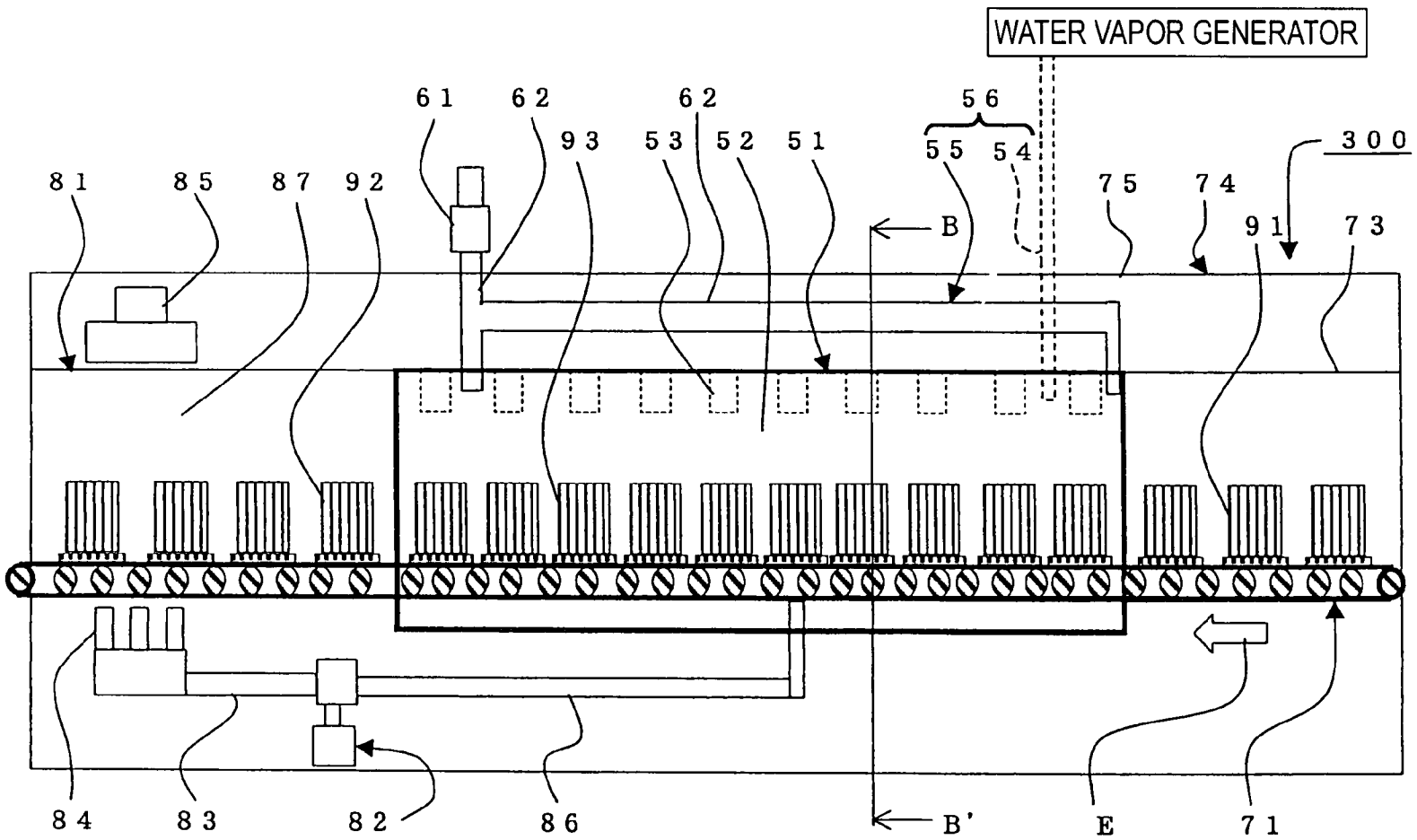
FIG. 7 A schematic cross-sectional view showing an embodiment according to a first mode of the honeycomb formed body drying apparatus of the present invention.

An embodiment of the first mode of the honeycomb formed body drying apparatus of the present invention will next be described. FIG. 7 is a schematic cross-sectional view showing an embodiment according to the first mode of the honeycomb formed body drying apparatus of the present invention.

The apparatus 300 of the present embodiment for drying a honeycomb formed body (hereinafter may be referred to simply as "drying apparatus 300") shown in FIG. 7 is such that a honeycomb formed body in an undried state (i.e., undried honeycomb formed body) 91 which is formed from a raw material composition containing a ceramic raw material and water and which has a plurality of cells defined by partition walls is subjected to high-frequency heating through electromagnetic wave irradiation, whereby water is vaporized from an inner part and an outer part of the undried honeycomb formed body 91 so as to dry the undried honeycomb formed body 91, thereby producing a dried honeycomb formed body 92. The inner part and outer part of the undried honeycomb formed body 91 are the same as the inner part and outer part of the undried honeycomb formed body 41 shown in FIG. 1 dried through the aforementioned honeycomb formed body drying method of the present invention.

The drying apparatus 300 of the embodiment includes, in a cylindrical outer frame 74, a drying chamber 51 having a drying space 52 for accommodating an undried honeycomb formed body 91 in a humidified and heated atmosphere; an electromagnetic wave generator 53 for generating an electromagnetic wave with which the undried honeycomb formed body 91 accommodated in the drying chamber 51 is to be irradiated such that 50 to 99 mass % of water contained in the undried formed body 91 is evaporated at the end of irradiation; and an atmosphere controlling unit 56 having a water vapor feeding means 54 and a forced discharge means 55 and allowing the humidified and heated atmosphere in the drying space 52 to maintain at a humidity level as low as 30 to 65% and a temperature of 75 to 130° C.

The outer frame 74 forming the drying apparatus 300 is formed in a cylindrical shape such that the center axis is oriented virtually in the horizontal direction. An undried honeycomb formed body 91 is transferred into the drying apparatus through one end of the cylinder, and the dried honeycomb formed body 92 is removed through the other end thereof. In the outer frame 74, a ceiling 73 is disposed virtually in the horizontal direction so as to provide a space between the ceiling and a roof 75 of the outer frame, and divides the outer frame 74 into two chambers. The drying chamber 51 is formed into a cylinder, and the center axis of the cylinder virtually aligns the center axis of the outer frame 74. The drying chamber is disposed under (in the vertical direction) the roof 75 formed in the outer frame 74. In the drying chamber 300, a conveyer 71 is disposed so as to extend from one end (inlet end) of the outer frame 74 to the other end (outlet end) of the outer frame 74 through the inside of the cylindrical drying chamber 51 so that the undried honeycomb formed bodies 91 are continuously transferred into the chamber and the thus-dried honeycomb formed bodies 92 are continuously removed to the outside. No particular limitation is imposed on the type of the conveyer 71, and a belt conveyer, a roller conveyer, and other conveyers may be employed.

In the embodiment, the honeycomb formed body drying apparatus 300 has the above configuration. The humidified and heated atmosphere in the drying space 52 is maintained at a humidity level as low as 30 to 65% and a temperature of 75 to 130° C. by means of an atmosphere controlling unit 56. In order to evaporate 50 to 99 mass % of water contained in the formed body 91 at the end of high-frequency heating, the amount of water vaporized from the outer part of the undried honeycomb formed body 91, which amount is smaller than that of water vaporized from the inner part of the formed body 91 through high-frequency heating alone, is increased (in the aforementioned humidified and heated atmosphere), thereby reducing a difference between amount of water vaporized from the inner part of the undried honeycomb formed body 91 and that of water vaporized from the outer part thereof as well as reducing a difference between drying degree of the inner part of the undried honeycomb formed body 91 and that of the outer part thereof, thereby producing a dried honeycomb formed body 92 in which deformation of the partition walls caused by the difference between drying degree of the inner part and that of the outer part is suppressed. The difference in water content between the inner part of the dried honeycomb formed body 92 and the outer part thereof (the amount of water of the undried honeycomb formed body from which the amount of vaporized water has been subtracted is divided by the amount of water which the undried honeycomb formed body has contained, and the value is multiplied with 100) is preferably 10 mass % or less. Through controlling the water content, deformation of the partition walls caused by the difference between drying degree of the inner part and that of the outer part can be suppressed.

Deformation of the partition walls caused by the difference between drying degree of the inner part and that of the outer part occurs by the following mechanism. During drying of the undried honeycomb formed body 91, partition walls are shrunken. If the honeycomb formed body is not dried uniformly, difference in shrinkage degree of partition walls is provided. The difference causes warpage. Thus, deformation of partition walls such as warpage occurs. In the embodiment of the honeycomb formed body drying method, such deformation of partition walls can be prevented. The term "deformation of partition walls" is used to refer to warpage of partition walls, generation of wrinkles, generation of wrinkles in the outermost peripheral surface wall, formation of dents, etc.

When the humidity level in the drying space 52 is lower than 30%, an outer peripheral surface wall 94 (see FIG. 4) of the undried honeycomb formed body 91 is dried excessively rapidly. Thus, defects are generated in the outer peripheral surface wall 94, which is problematic. A humidity level in the drying space of higher than 65% is also problematic. Specifically, the amount of water vaporized from the outer part of the undried honeycomb formed body 91 is generally smaller than that of vaporized from the inner part at an initial drying stage, providing a difference in drying degree between the inner part and the outer part, resulting in deformation of partition walls such as wrinkles. When the humidity level is excessively high, the difference in drying degree between the inner part and the outer part increases, resulting in deformation of partition walls, which is problematic. In addition, when the humidity level is high, the amount of water vaporized from the undried honeycomb formed body problematically decreases due to loss of the energy of the input electromagnetic wave. Therefore, the humidity level in the drying space 52 is more preferably 30 to 50%.

When the inside temperature of the drying space 52 is lower than 75° C., the undried honeycomb formed body 91 is difficult to dry, resulting in problematic wrinkles in the outer peripheral surface wall, whereas when the temperature is higher than 130° C., substances other than water such as an organic binder contained in the undried honeycomb formed body 91 are vaporized, leading to deformation of partition walls of the undried honeycomb formed body 91, and the organic binder may be burnt. Needless to say, both cases are problematic. Thus, the inside temperature of the drying space 52 is preferably 90 to 110° C. When the inside temperature falls within a range of 75 to 90° C., the produced honeycomb formed bodies have no problem in quality. However, difference in water content between the inner part of the honeycomb formed body and the outer part thereof as low as less than 10 mass % may result. In addition, a longer drying time may be required so as to compensate drop in drying efficiency.

When the percent vaporized water amount of the undried honeycomb formed body is less than 50 mass %, shrinkage of the honeycomb formed body is not complete. When water is further vaporized, the honeycomb formed body further shrinks not uniformly, resulting in deformation of partition walls of the honeycomb formed body, which is problematic. When the percent vaporized water amount of the undried honeycomb formed body is more than 99 mass %, the honeycomb formed body is over dried locally, and scorching may occur due to burning of a binder, which is also problematic. As used herein, the term "percent vaporized water amount of the undried honeycomb formed body" refers to a value obtained by dividing the mass of vaporized water by the mass of water contained in the undried honeycomb formed body and multiplying 100.

When the undried honeycomb formed body 92 is dried by means of the drying apparatus 300 of the present embodiment, the following procedure is employed. Firstly, the undried honeycomb formed body 91 is transferred into the chamber through one end of the outer frame 74 and placed on the conveyer 71. The undried honeycomb formed body 91 is conveyed through driving force of the conveyer 71 so as to move in the honeycomb formed body conveyance direction E, followed by transferring into the drying chamber 51 through one end of the drying chamber 51 by means of the conveyer 71. While the undried honeycomb formed body 91 is conveyed by means of the conveyer 71 in the drying chamber 51 as a honeycomb formed body 93 in a drying state, the undried honeycomb formed body 91 is subjected to high-frequency heating for drying through irradiation with an electromagnetic wave generated by the electromagnetic wave generator 53 in the drying space 52 of which atmosphere is controlled to a predetermined humidity and temperature by means of the atmosphere controlling unit, to thereby form the dried honeycomb formed body 92. Subsequently, the thus-dried honeycomb formed body 92 is removed from the drying chamber 51 through the other end thereof and transferred to a hot air drying chamber 81. The dried honeycomb formed body 92 is conveyed by means of the conveyer 71 in the hot air drying chamber 81, while further dried through application of hot air to the formed body 92. Subsequently, the formed body 92 is removed from the hot air drying chamber 81 and the drying apparatus 200.

As shown in FIG. 7, the drying apparatus 300 includes the atmosphere controlling unit 56 for controlling the drying space 52 in the drying chamber 51 to a predetermined humidity and temperature. The atmosphere controlling unit 56 has a water vapor feeding means 54 for feeding water vapor into the drying chamber 51, and a forced discharge means 55 for discharging the drying chamber 51. The water vapor feeding means 54 is a piping having at the tip nozzles through which water vapor is discharged, and the tip is inserted in the drying chamber 51. Water vapor to be employed is generated by means of, for example, a water vapor generator and fed through the piping. In the forced discharge means 55, the piping connected to a blower for forced discharge 61 is branched into two. The tip of one branch is inserted into the space near one end of the drying chamber 61, and the tip of the other branch is inserted into a space near the other end of the drying chamber 51. The gas present in the drying chamber 51 is discharged so as to control the atmosphere of the drying space 52 by means of the blower for forced discharge 61 to the outside in accordance with need through the piping.

The water vapor that is fed through the water vapor feeding means 54 into the drying chamber 51 preferably has a temperature of 100 to 120° C. The amount of water vapor fed into the drying chamber 51 and the amount of discharge from the drying chamber 51 to the outside through the blower for forced discharge 61 are appropriately determined in accordance with factors such as the capacity of the drying chamber 51, and the number and dimensions of honeycomb formed bodies accommodated in the drying chamber 51. For example, when the capacity of the drying chamber 51 is about 7 $m^3$, the water vapor in flow is preferably 90 to 120 kg/Hr, and the discharge rate is preferably 20 to 50 $m^3$/min.

Figure 8:
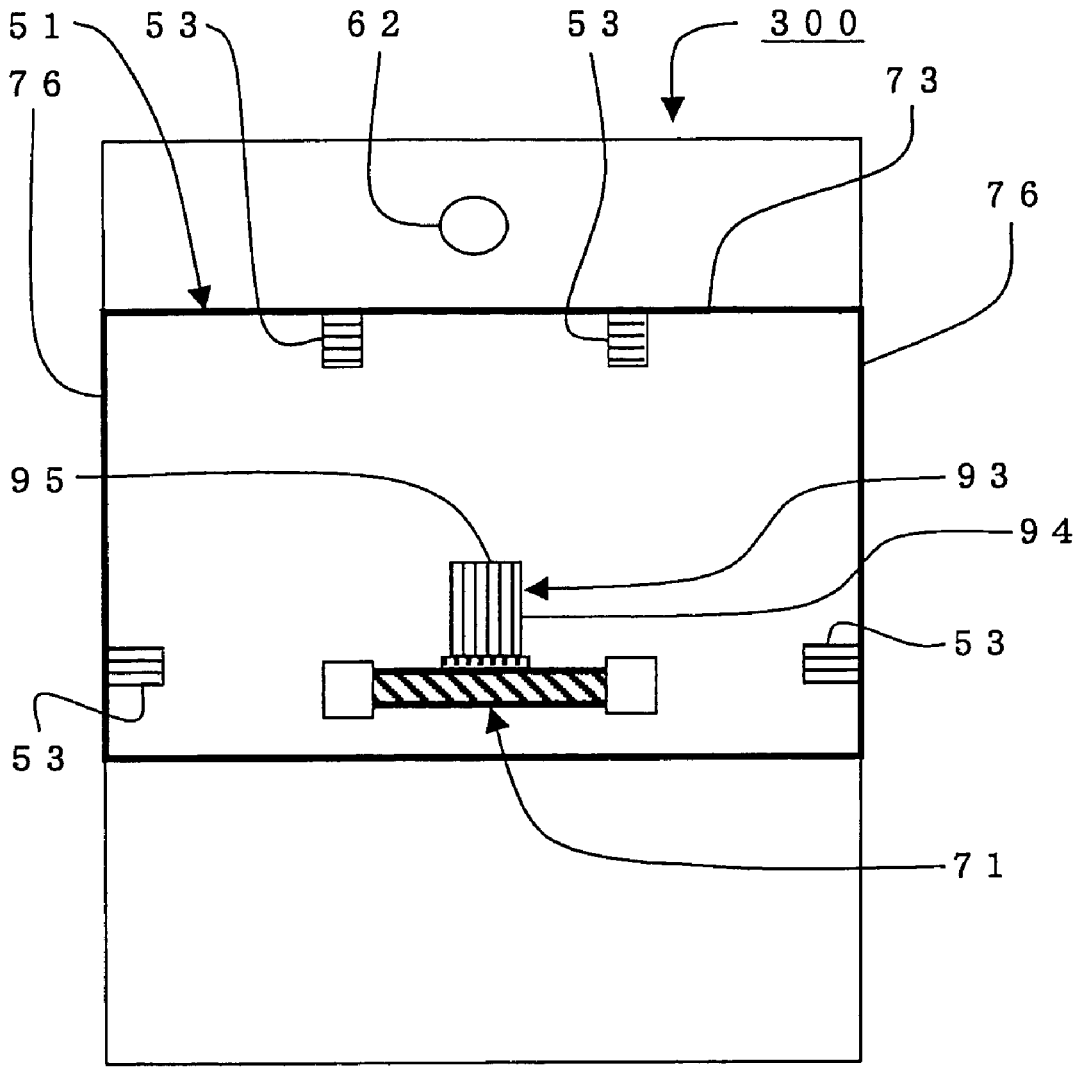
FIG. 8 A cross-section taken along line B-B' in FIG. 7.

As shown in FIG. 7, electromagnetic wave generators 53 are disposed on the inner surface of the ceiling 73 of the drying chamber 51 along the center axis of the outer frame 74. The electromagnetic wave generators 53 are distributed in ten zones located with virtually the same intervals. In each zone, as shown in FIG. 8, two electromagnetic wave generators are disposed on the ceiling 73 and one electromagnetic wave generator on each side surface 76; i.e., total four electromagnetic wave generators 53 are disposed. Thus, 40 electromagnetic wave generators 53 are disposed in the drying chamber 51. FIG. 8 is a cross-section taken along line B-B' in FIG. 7. According to the embodiment of the honeycomb formed body drying method, the drying honeycomb formed body 93 is irradiated with an electromagnetic wave of the outer peripheral surface wall 94 side and the top end 95 side. Thus, the inside of the honeycomb formed body is more uniformly irradiated with an electromagnetic wave, and the entirety of the honeycomb formed body more uniformly undergoes high-frequency heating, which is preferred. No particular limitation is imposed on the place and number of the electromagnetic wave generators 53 to be disposed. For example, in each zone, one electromagnetic wave generator 53 may be placed at any place. Alternatively, five or more electromagnetic wave generators 53 may be disposed at any places. The number of the zones where an electromagnetic wave generator 53 is disposed is not limited to ten, and may be appropriately determined in accordance with factors such as the length of the drying chamber 51. The electromagnetic wave generator 53 is preferably disposed at such a place that the electromagnetic wave is applied to the honeycomb formed body 93 as uniformly as possible. Preferably, the drying chamber 51 is covered with a heat insulating material, whereby the inside temperature of the drying chamber 51 is maintained. In addition, the outer frame 74 is preferably surrounded by a heat insulating material.

In the embodiment of the honeycomb formed body drying method, the electromagnetic wave employed for drying preferably has a frequency of 900 to 10,000 MHz, more preferably 2,000 to 10,000 MHz. When the frequency is lower than 900 MHz, water is difficult to undergo high-frequency heating, and a honeycomb formed body may be difficult to dry. In contrast, when the frequency is higher than 2,000 MHz, water effectively undergoes high-frequency heating. As shown in FIG. 4, the electromagnetic wave generators 53 may be disposed inside the drying chamber 51. Alternatively, electromagnetic wave generators 53 may be disposed outside the drying chamber 51, and the generated electromagnetic wave is guided through a predetermined site of the drying chamber 51 into the drying chamber 51 via a waveguide so as to apply the electromagnetic wave to the drying honeycomb formed body 93.

The energy of the electromagnetic wave applied to the honeycomb formed body is appropriately determined in accordance with factors such as the capacity of the drying chamber 51, and the number and dimensions of honeycomb formed bodies accommodated in the drying chamber 51. For example, when the capacity of the drying chamber 51 is about 7 $m^3$, the total energy is preferably 150 to 300 kW. When the energy is smaller than 150 kW, the honeycomb formed body may fail to be dried to a predetermined drying degree, whereas when the energy is higher than 300 kW, the vaporization speed of water from the honeycomb formed body is elevated, difficulty may be encountered in reduction of the difference in drying condition between the inner part of the honeycomb formed body and the outer part thereof.

As shown in FIG. 7, the drying apparatus 300 of the embodiment includes a hot air drying chamber 81 provided in the vicinity of the outlet of the outer frame 74. The hot air drying chamber 81 is present in the vicinity of the outlet of the outer frame 74 and has a space between the ceiling 73 and the conveyer 71 (hot air drying space 87). As mentioned above, in the hot air drying chamber 81, hot air is applied to the dried honeycomb formed body 92 for further drying. Upon performance of further drying in the hot air drying chamber 81, the dried honeycomb formed body 92 is transferred by means of a conveyer 71 to a hot air drying chamber 81. Preferably, the hot air fed through hot air feeding nozzles 84 disposed under the hot air drying chamber 81 is applied to the dried honeycomb formed body 92 in the direction from the bottom to the top end. The hot air fed through hot air feeding nozzles 84 to the hot air drying chamber 81 is discharged to the outside through a hot air discharge duct 85 disposed above the hot air drying chamber 81 (space between the ceiling 73 and the roof 75). The aforementioned hot air preferably has a temperature of 100 to 130° C. When the temperature is lower than 100° C., the dried honeycomb formed body may be difficult to dry, whereas when the temperature is higher than 130° C., substances other than water such as an organic binder contained in the undried honeycomb formed body 91 are vaporized, causing deformation of partition walls of the undried honeycomb formed body 91 and burning of the organic binder and other substances, which are problematic.

The hot air feeding nozzles 84 are linked to the hot air generator 82 via a piping so that the hot air generated by the hot air generator 82 is transferred via the piping and discharged through the hot air feeding nozzles 84. No particular limitation is imposed on the type of the hot air generator 82 so long as the generator attains predetermined temperature and flow rate. For example, a hot air generator having a heater employing high-temperature water vapor or an electric heater and a blower may be used. In the generator, a blow generated by the blower is heated to provide hot air. The hot air generated by the hot air generator 82 may be used for preliminarily heating the unheated drying chamber 51 before the start of electromagnetic wave drying of the undried honeycomb formed body. In FIG. 7, hot air is fed into the drying chamber 51 via a piping for preliminary heating 86 connected to the hot air generator 82.

The honeycomb formed body to be suitably dried in the embodiment is made of ceramic material, having a percent opening of 80% or more and a partition wall thickness of 0.18 mm or less. As used herein, the term "percent opening" refers to a ratio (percent) of the total cross-sectional area of the cell through-holes to the cross-sectional area of the honeycomb formed body in which the cell through-holes are located, as viewed in a cross-section of a honeycomb formed body cut in a direction normal to the center axis.

The drying apparatus of the embodiment continuously dries honeycomb formed bodies and may be a batch-type. In use, the batch-type drying apparatus is such that a predetermined number of undried honeycomb formed bodies are accommodated therein and irradiated with an electromagnetic wave to thereby dry the honeycomb formed bodies; irradiation of the electromagnetic wave is stopped; the thus-dried honeycomb formed bodies are removed; another predetermined number of undried honeycomb formed bodies are accommodated therein; and irradiation of an electromagnetic wave is started.

Figure 9:
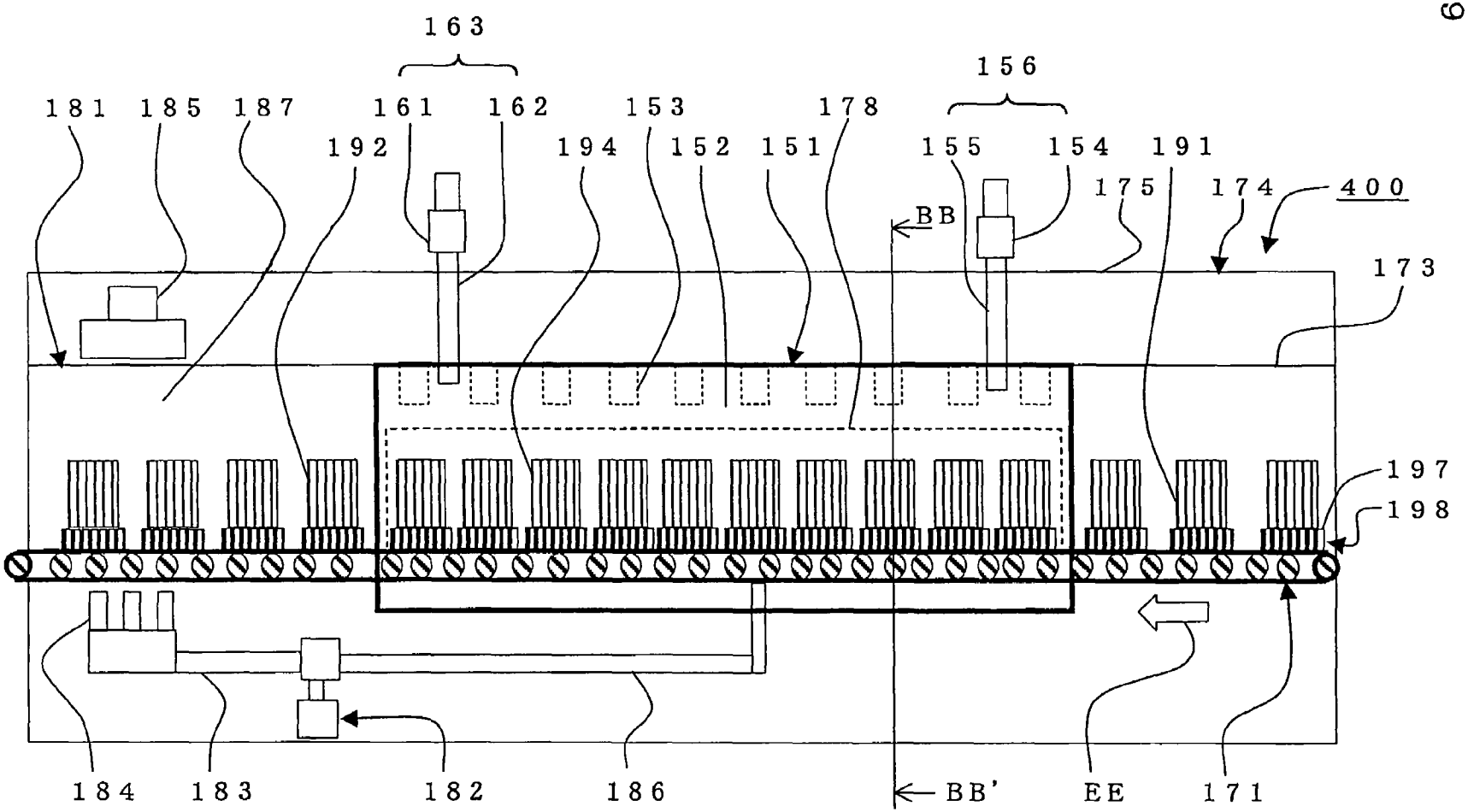
FIG. 9 A schematic cross-sectional view showing an embodiment according to a second mode of the honeycomb formed body drying apparatus of the present invention.

An embodiment of the second mode of the honeycomb formed body drying apparatus of the present invention will next be described. FIG. 9 is a schematic cross-sectional view showing an embodiment according to the second mode of the honeycomb formed body drying apparatus of the present invention.

The apparatus 400 of the present embodiment for drying a honeycomb formed body (hereinafter may be referred to simply as "drying apparatus 400") shown in FIG. 9 is such that a honeycomb formed body in an undried state (i.e., undried honeycomb formed body) 191 which is formed from a raw material composition containing a ceramic raw material and water and which has a plurality of cells defined by partition walls is subjected to high-frequency heating through electromagnetic wave irradiation, whereby water is vaporized from an inner part and an outer part of the undried honeycomb formed body 191 so as to dry the undried honeycomb formed body 191, thereby producing a dried honeycomb formed body 192. The inner part and outer part of the undried honeycomb formed body 191 are the same as the inner part and outer part of the undried honeycomb formed body 141 shown in FIG. 3 dried through the aforementioned honeycomb formed body drying method of the present invention.

The drying apparatus 400 includes, in a cylindrical outer frame 174, a drying chamber 151 having a drying space 152 for accommodating an undried honeycomb formed body 191 in a humidified and heated atmosphere; an electromagnetic wave generator 153 for generating an electromagnetic wave with which the undried honeycomb formed body 191 accommodated in the drying chamber 151 is to be irradiated for performing high-frequency heating of the undried honeycomb formed body 191; and a hot air feeding unit 156 for feeding hot air into the drying space 152, which hot air feeding unit being provided so that the amount of water vaporized from the outer part of the undried honeycomb formed body 191, which amount is smaller than that of water vaporized from the inner part of the formed body through high-frequency heating alone, is increased, such that 50 to 99 mass % of water contained in the undried formed body 191 is evaporated at the end of irradiation, and the humidified and heated atmosphere in the drying space 152 is maintain at a humidity level as low as 30 to 65% and a temperature of 75 to 130° C. The drying apparatus 400 of the embodiment further has a hot air application apparatus 178 for applying hot air for heating to the outer peripheral surface wall of the undried honeycomb formed body 191 accommodated in the drying chamber 151, and a forced discharge means 163 for forcedly discharging the drying space 152.

The outer frame 174 forming the drying apparatus 400 is formed in a cylindrical shape such that the center axis is oriented virtually in the horizontal direction. An undried honeycomb formed body 191 is transferred into the drying apparatus through one end of the cylinder, and the dried honeycomb formed body 192 is removed through the other end thereof. In the outer frame 174, a ceiling 173 is disposed virtually in the horizontal direction so as to provide a space between the ceiling and a roof 175 of the outer frame, and divides the outer frame 174 into two chambers. The drying chamber 151 is formed into a cylinder, and the center axis of the cylinder virtually aligns the center axis of the outer frame 174. The drying chamber is disposed under (in the vertical direction) the roof 175 formed in the outer frame 174. In the drying chamber 400, a conveyer 171 is disposed so as to extend from one end (inlet end) of the outer frame 174 to the other end (outlet end) of the outer frame 174 through the inside of the cylindrical drying chamber 151 so that the undried honeycomb formed bodies 191 are continuously transferred into the chamber and the thus-dried honeycomb formed bodies 192 are continuously removed to the outside.

In the vicinity of the inlet end of the drying chamber 151 for transferring the undried honeycomb formed bodies 191, there is provided a hot air feeding unit 156 having a hot air generator 154 for generating hot air and a hot air introducing member 155 for feeding hot air generated by the hot air generator 154 into the drying space 152 of the drying chamber 151. The hot air fed into the drying space 152 through the hot air feeding unit 156 is applied to the undried honeycomb formed body 191 transferred into the drying space 152, thereby drying the undried honeycomb formed body 191.

In the vicinity of the outlet end of the drying chamber 151 for removing the undried honeycomb formed bodies 191, there is provided a forced discharge means 163 having a blower for forced discharge 161 and a duct for forced discharge 162, through which means the drying space 152 is discharged.

In the drying chamber 151, a hot air application apparatus 178 is disposed so as to sandwich the conveyer 171 along the direction EE of transferring the undried honeycomb formed body 191. The hot air application apparatus 178 has a second hot air application section (not illustrated) for applying hot air (second hot air). The second hot air application section (not illustrated) is formed such that the second hot air is applied to the outer peripheral wall 144 in two directions opposing each other and being normal to the center axis of the undried honeycomb formed body 191, whereby the second hot air is applied to the undried honeycomb formed body 191 in two directions so as to sandwich the outer peripheral wall 194.

Preferably, the distance between the application site of the second hot air application section and the outer peripheral surface wall of the honeycomb formed body is 0.1 to 1.0 m. When the distance is less than 0.1 m, the hot air may applied to a portion of the outer peripheral surface wall, whereas when the distance is in excess of 1.0 m, the second hot air which cannot be applied to the outer peripheral surface wall but which is fed to the other sites predominates, possibly reducing the second hot air application efficiency.

Preferably, the second blow application section of the hot air application apparatus 178 has a plurality of tubular nozzles (hot air application nozzles), through which hot air is applied to the outer peripheral surface wall 194 of the undried honeycomb formed body 191. More preferably, the hot air application nozzles are aligned along the center axis (top to bottom) of the undried honeycomb formed body 191, while the axis of each hot air application nozzle is aligned in the horizontal direction and the tip of the nozzle faces the outer peripheral surface wall 194, whereby the second hot airs are simultaneously applied to the outer peripheral surface wall 194 from the top end to the bottom thereof. In this case, the line passing through the nozzle tips is virtually aligned in the center axis of the undried honeycomb formed body 191. Through employment of the configuration, the second hot air can be applied to the entire outer peripheral surface wall 194 during movement of the undried honeycomb formed body 191. Preferably, a plurality of sets of nozzles being aligned in the center axis of the undried honeycomb formed body 191 are arranged in the direction EE of transferring the undried honeycomb formed body 191 such that the nozzle lines are arranged virtually in parallel one another, whereby second hot airs provided by the nozzle sets are sequentially applied to the outer peripheral surface wall 194 during transfer of the undried honeycomb formed body 191. However, the nozzles in each nozzle set are not necessarily in the same line, and a zigzag or an irregular arrangement may also be employed, so long as the second hot air can be applied to the outer peripheral surface wall 194 uniformly from the top end to the bottom thereof.

The second hot air application section does not necessarily have hot air application nozzles and, instead, may have a piping having a plurality of holes through which the hot air is applied. No particular limitation is imposed on the position and number of the hot air application nozzles and the holes of the piping so long as the hot air can be effectively applied to the entire outer peripheral surface wall 194 of the undried honeycomb formed body 191. Preferably, the position and number of the hot air application nozzles and the holes of the piping can be altered in accordance with the dimensions undried honeycomb formed body 191.

In the embodiment, the honeycomb formed body drying apparatus 400 has the above configuration. The humidified and heated atmosphere in the drying space 152 is maintained at a humidity level as low as 30 to 65% and a temperature of 75 to 130° C. by means of hot air. In order to evaporate 50 to 99 mass % of water contained in the formed body 141 at the end of heating, the amount of water vaporized from the outer part of the undried honeycomb formed body 191, which amount is smaller than that of water vaporized from the inner part of the formed body 191 through high-frequency heating alone, is increased through high-frequency heating of the undried honeycomb formed body 191 and application of the hot air to the undried honeycomb formed body 191 (in the aforementioned humidified and heated atmosphere with application of the hot air to the outer peripheral wall 194), thereby reducing a difference between amount of water vaporized from the inner part of the undried honeycomb formed body 191 and that of water vaporized from the outer part thereof as well as reducing a difference between drying degree of the inner part of the undried honeycomb formed body 191 and that of the outer part thereof, thereby producing a dried honeycomb formed body 192 in which deformation of the partition walls caused by the difference between drying degree of the inner part and that of the outer part is suppressed. The difference in water content between the inner part of the dried honeycomb formed body 192 and the outer part thereof (the amount of water of the undried honeycomb formed body from which the amount of vaporized water has been subtracted is divided by the amount of water which the undried honeycomb formed body has contained, and the value is multiplied with 100) is preferably 10 mass % or less. Through controlling the water content, deformation of the partition walls caused by the difference between drying degree of the inner part and that of the outer part can be suppressed.

In addition to the hot air fed by means of the hot air feeding unit 156, hot air (second hot air) is applied to the outer peripheral surface wall 194 of the undried honeycomb formed body 191 at a predetermined distance from the wall, to thereby further reduce a difference between drying degree of the inner part of the undried honeycomb formed body 191 and that of the outer part thereof, thereby further suppressing deformation of the partition walls caused by the difference between drying degree of the inner part and that of the outer part. In order to promote drying of the outer part, which is difficult to dry through sole high-frequency, and to control the drying state to that of the inner part, which is readily dried through sole heating high-frequency heating, preferably, application of the second hot air applied to the outer peripheral surface wall 194 of the undried honeycomb formed body 191 is carried out only to the outer peripheral surface wall 194 of the undried honeycomb formed body 191 and not to the top end and the bottom thereof. If the second hot air is applied to the top end and the bottom, the difference in the amount of water vaporization between the inner part of the undried honeycomb formed body 191 and the outer part thereof may be difficult to reduce.

Deformation of the partition walls caused by the difference between drying degree of the inner part and that of the outer part occurs by the following mechanism. During drying of the undried honeycomb formed body 191, partition walls are shrunken. If the honeycomb formed body is not dried uniformly, difference in shrinkage degree of partition walls is provided. The difference causes warpage. Thus, deformation of partition walls such as warpage occurs. In the embodiment of the honeycomb formed body drying method, such deformation of partition walls can be prevented. The term "deformation of partition walls" is used to refer to warpage of partition walls, generation of wrinkles, generation of wrinkles in the outermost peripheral surface wall, formation of dents, etc.

When the humidity level in the drying space 152 is lower than 30%, an outer peripheral surface wall 194 of the undried honeycomb formed body 191 is dried excessively rapidly. Thus, defects are generated in the outer peripheral surface wall 194, which is problematic. A humidity level in the drying space of higher than 65% is also problematic. Specifically, the amount of water vaporized from the outer part of the undried honeycomb formed body 191 is generally smaller than that of vaporized from the inner part at an initial drying stage, providing a difference in drying degree between the inner part and the outer part, resulting in deformation of partition walls such as wrinkles. When the humidity level is excessively high, the difference in drying degree between the inner part and the outer part increases, resulting in deformation of partition walls, which is problematic. In addition, when the humidity level is high, the amount of water vaporized from the undried honeycomb formed body problematically decreases due to loss of the energy of the input electromagnetic wave. Therefore, the humidity level in the drying space 52 is more preferably 30 to 50%.

When the inside temperature of the drying space 152 is lower than 75° C., the undried honeycomb formed body 191 is difficult to dry, resulting in problematic wrinkles in the outer peripheral surface wall, whereas when the temperature is higher than 130° C., substances other than water such as an organic binder contained in the undried honeycomb formed body 191 are vaporized, leading to deformation of partition walls of the undried honeycomb formed body 191, and the organic binder may be burnt. Needless to say, both cases are problematic. Thus, the inside temperature of the drying space 152 is preferably 90 to 110° C. When the inside temperature falls within a range of 75 to 90° C., the produced honeycomb formed bodies have no problem in quality. However, difference in water content between the inner part of the honeycomb formed body and the outer part thereof as low as less than 10 mass % may result. In addition, drying of the entire molded body may be insufficient.

When the percent vaporized water amount of the undried honeycomb formed body is less than 50 mass %, shrinkage of the honeycomb formed body is not complete. When water is further vaporized, the honeycomb formed body further shrinks not uniformly, resulting in deformation of partition walls of the honeycomb formed body, which is problematic. When the percent vaporized water amount of the undried honeycomb formed body is more than 99 mass %, the honeycomb formed body is over dried locally, and scorching may occur due to burning of a binder, which is also problematic. As used herein, the term "percent vaporized water amount of the undried honeycomb formed body" refers to a value obtained by dividing the mass of vaporized water by the mass of water contained in the undried honeycomb formed body and multiplying 100.

The hot air fed through the hot air feeding unit 156 into the drying space 52 preferably has a velocity of 0.5 to 10 m/s, more preferably 2 to 10 m/s, and preferably has a flow rate of 3 to 60 $m^3$/s, more preferably 12 to 60 $m^3$/s. When the velocity is less than 0.5 m/s, heating of the outer part of the undried honeycomb formed body 191 through the hot air may be insufficient, whereas when the velocity is more than 10 m/s, the undried honeycomb formed body 191 may undesirably be moved, or the outer peripheral surface wall 194 may be deformed. When the flow rate is less than 3 $m^3$/s, heating of the outer part of the undried honeycomb formed body 191 through the hot air may be insufficient, whereas when the flow rate is more than 60 $m^3$/s, the undried honeycomb formed body 191 may undesirably be moved, or the outer peripheral surface wall 194 may be deformed.

The hot air fed through the hot air feeding unit 156 into the drying space 152 preferably has a temperature of 80 to 135° C., more preferably 95 to 110° C. When the temperature is lower than 80° C., the effect of promoting vaporization of water from the outer part of the undried honeycomb formed body 191 may be reduced, whereas when the temperature is higher than 135° C., substances other than water such as an organic binder contained in the undried honeycomb formed body 191 are vaporized, leading to deformation of partition walls of the undried honeycomb formed body 191, and the organic binder may be burnt, which are problematic.

The hot air fed through the hot air feeding unit 156 into the drying space 152 preferably has a humidity level of 20% or less, more preferably 15% or less. When the humidity level is higher than 20%, the effect of promoting vaporization of water from the outer part of the undried honeycomb formed body 191 may be reduced.

In the present embodiment, in addition to the aforementioned hot air fed through the hot air feeding unit 156, a second hot air is preferably applied to the outer peripheral surface wall 194 of the undried honeycomb formed body 191 at a predetermined distance from the wall. In this case, the second hot air preferably has a velocity of 0.5 to 10 m/s, more preferably 2 to 10 m/s. When the velocity is less than 0.5 m/s, heating of the outer part of the undried honeycomb formed body 191 through the second hot air may be insufficient, the effect of promoting vaporization of water from the outer peripheral surface wall 194 of the undried honeycomb formed body 191 by virtue of the second hot air may be reduced, the effect being based on blowing out water vapor residing in the vicinity of the outer peripheral surface wall 194 of the undried honeycomb formed body 191, whereby the humidity around the outer peripheral surface wall 194 is reduced. When the velocity is more than 10 m/s, the undried honeycomb formed body 191 may undesirably be moved, or the outer peripheral surface wall 194 may be deformed. Upon application of the second hot air to the outer peripheral surface wall 194 of the undried honeycomb formed body 191, the second hot air is preferably applied to the entire outer peripheral surface wall 194. Thus, the second hot air can be applied to the entire outer peripheral surface wall 194 at the aforementioned predetermined velocity, whereby vaporization of water from the outer peripheral surface wall 194 of the undried honeycomb formed body 191 can be effectively promoted.

The second hot air fed through the hot air application apparatus 178 to the outer peripheral surface wall 194 preferably has a temperature of 80 to 135° C., more preferably 95 to 110° C. When the temperature is lower than 80° C., the effect of promoting vaporization of water from the outer part of the undried honeycomb formed body 191 may be reduced, whereas when the temperature is higher than 135° C., substances other than water such as an organic binder contained in the undried honeycomb formed body 191 are vaporized, leading to deformation of partition walls of the undried honeycomb formed body 191, and the organic binder may be burnt, which are problematic.

The second hot air fed through the hot air application apparatus 178 to the outer peripheral surface wall 194 preferably has a humidity level of 20% or less. When the humidity level is higher than 20%, the effect of promoting vaporization of water from the outer part of the undried honeycomb formed body 191 may be reduced.

In the present embodiment, the aforementioned hot air feeding unit 156 has a hot air generator 154 for generating hot air and a hot air introducing member 155 for feeding hot air generated by the hot air generator 154 into the drying space 152 of the drying chamber 151. No particular limitation is imposed on the type of the hot air generator 154 so long as the generator attains predetermined temperature and flow rate. For example, a hot air generator having a heater employing high-temperature water vapor or an electric heater and a blower may be used. In the generator, a blow generated by the blower is heated to provide hot air. The temperature of the hot air low may be controlled basically by means of the above heater, and the humidity thereof may be controlled by means of a demoisturizer or a similar device.

As shown in FIG. 9, the tubular nozzle of the hot air introducing member 155 may be inserted into the drying chamber 151. Alternatively, the drying chamber 151 may be provided with a hole; the hot air generated by the hot air generator 154 is transferred to the hole through a piping; and the hot air is introduced into the drying chamber 151 through the hole. When the nozzle is inserted into the drying chamber 151, the nozzle is preferably oriented in a desired direction.

During drying of an undried honeycomb formed body in the drying chamber, when a second hot air is applied by means of a hot air application apparatus to the undried honeycomb formed body in an initial drying stage, the outer peripheral surface wall of the undried honeycomb formed body may be more rapidly dried as compared with the inner part thereof. Therefore, the second hot air is preferably applied, while whether or not the undried honeycomb formed body is sufficiently heated through high-frequency heating is checked by means of an IR sensor or a similar means. Alternatively, high-frequency heating is performed in an initial drying stage, and the second hot air is applied to the undried honeycomb formed body when the structure has reached a predetermined position in the drying chamber (i.e., position where the structure is in a sufficiently heated state through high-frequency heating).

When the undried honeycomb formed body 192 is dried by means of the drying apparatus 400 of the present embodiment, the following procedure is employed. Firstly, the undried honeycomb formed body 191 is transferred into the chamber through one end of the outer frame 174 and placed on the conveyer 171. The undried honeycomb formed body 191 is conveyed through driving force of the conveyer 171 so as to move in the honeycomb formed body conveyance direction E, followed by transferring into the drying chamber 151 through one end of the drying chamber 151 by means of the conveyer 171. While the undried honeycomb formed body 191 is conveyed by means of the conveyer 171 in the drying chamber 151, the undried honeycomb formed body 191 is subjected to high-frequency heating for drying through irradiation with an electromagnetic wave generated by the electromagnetic wave generator 153 in the drying space 152 of a predetermined humidity and temperature, and the hot air fed through the hot air feeding unit 156 is applied to the honeycomb formed body. In addition, the second hot air is applied to the outer peripheral wall 194 through the hot air application apparatus 178 so as to promote drying the outer part, to thereby form the dried honeycomb formed body 192 of which entirety is almost uniformly dried. Subsequently, the thus-dried honeycomb formed body 192 is removed from the drying chamber 151 through the other end thereof and transferred to a post-drying chamber 181. The dried honeycomb formed body 192 is conveyed by means of the conveyer 171 in the post-drying chamber 181, while further dried through application of hot air to the formed body 192. Subsequently, the formed body 192 is removed from the post-drying chamber 181 and the drying apparatus 400.

Figure 10:
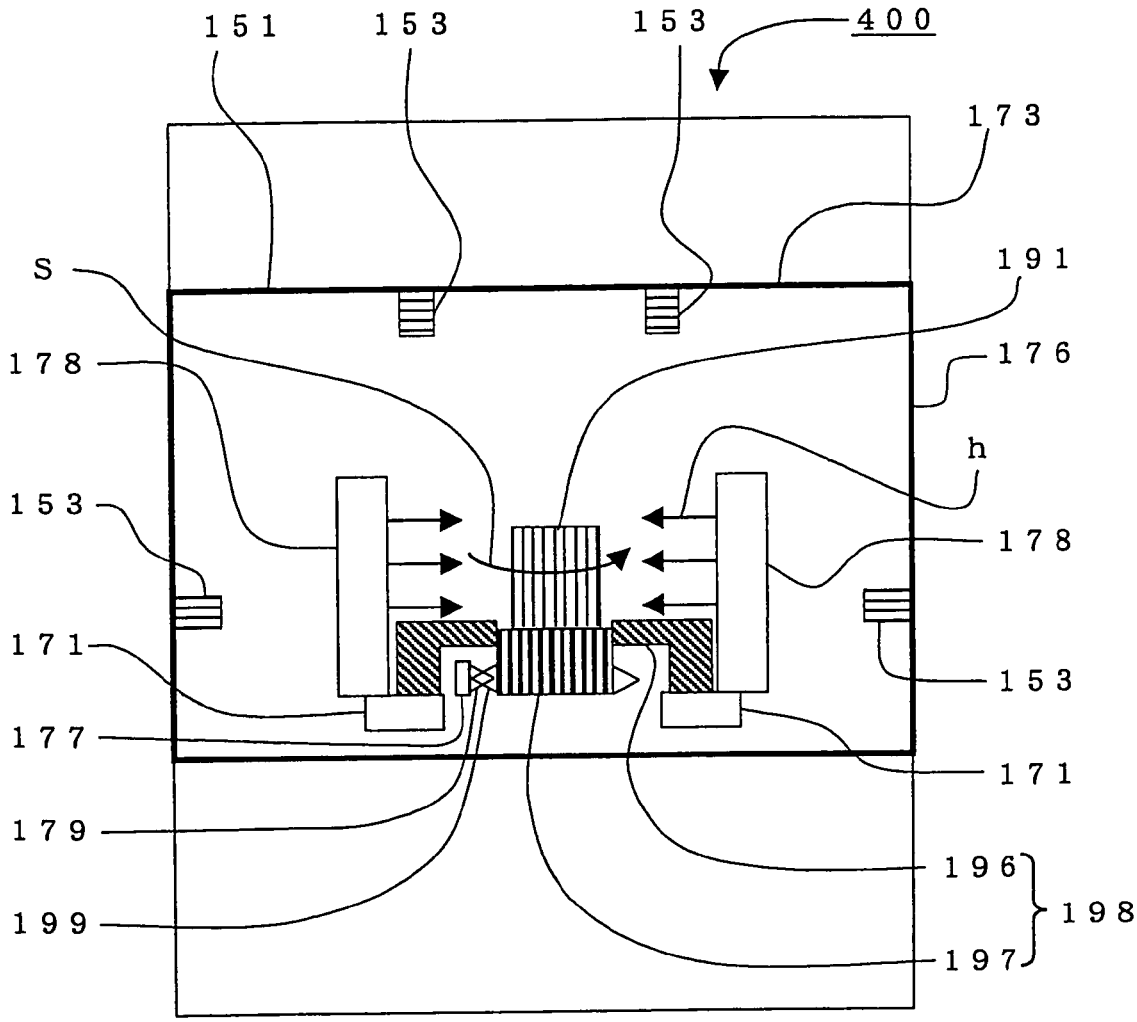
FIG. 10 A cross-section taken along line BB-BB' in FIG. 9.

The drying apparatus of the embodiment is preferably configured as shown in FIG. 10. Specifically, the drying apparatus has a stand 198 having a rotatable receiving member 197 and a support 196 for rotatably supporting the receiving member 197, the receiving member 197 being capable of rotating an undried honeycomb formed body 191 placed on an upper surface thereof virtually about the center axis of the receiving member 197, wherein the undried honeycomb formed body 191 is placed on the receiving member 197 of the stand 198 during drying of the undried honeycomb formed body 191 in a drying chamber 151; the undried honeycomb formed body 191 and the stand 198 are transferred into the drying chamber 151; the undried honeycomb formed body 191 is dried while the undried honeycomb formed body 191 is rotated in the rotational direction S through rotation of the receiving member 197 in the rotational direction S, to thereby provide a dried honeycomb formed body; and the dried honeycomb formed body and the stand 198 are removed from the drying chamber 151. Since hot air is applied to the undried honeycomb formed body 191 in a rotating state, the hot air is uniformly applied to the entire outer peripheral surface wall 194, which is preferred. For the similar reason, preferably, the second hot air is applied to the undried honeycomb formed body 191 in a rotating state.

In a preferred configuration for rotating the undried honeycomb formed body 191 in the drying chamber 151, the receiving member 197 forming the stand 198 has a pinion part 199 for allowing the receiving member 197 to rotate about the center axis, and the drying apparatus 400 further has, in the drying chamber 151, a rod-like rack part 177 is disposed along a conveyer 171, which is aligned in the longitudinal direction of the conveyer 171 and has rack part teeth 179 formed on one side facing the stand 198 and along the conveyer 171 such that the rack part teeth 179 are engaged with the pinion part 199 of the receiving member 197 during transfer of the undried honeycomb formed body 191 placed on the stand 198 by means of the conveyer 171. Through employment of the configuration, during transfer of the undried honeycomb formed body 191 placed on the stand 198 by means of the conveyer 171 in the drying chamber 151, the stand 198 is transferred while the rack part teeth 179 are engaged with the pinion part 199 of the receiving member 197, thereby rotating the receiving member 197 about the center axis thereof, whereby the undried honeycomb formed body 191 placed on the stand 198 is transferred in the drying apparatus 400 while rotating virtually about the center axis of the receiving member 197. Through employment of the drying apparatus 400 having the above configuration, the energy used to move the undried honeycomb formed body 191 partially serves as a driving source for rotating the undried honeycomb formed body 191. Therefore, an additional driving source is not required, which is preferred. FIG. 10 is a cross-section taken along line BB-BB' in FIG. 9.

Figure 11:
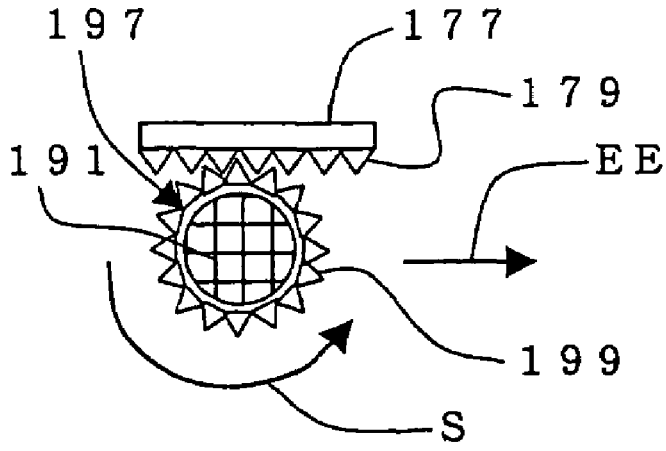
FIG. 11 A schematic plan view showing that the receiving member of the stand on which an undried honeycomb formed body is placed is rotated by means of the rack part.

FIG. 11 is a schematic plan view showing that the receiving member 197 of the stand on which the undried honeycomb formed body 191 is placed is rotated by means of the rack part 177. As shown in FIG. 11 and mentioned above, the mechanism for rotating the undried honeycomb formed body 191 involves transferring of the stand in the EE direction while the pinion part 199 of the receiving member 197 is engaged with the rack part teeth 179 of the rack part 177 affixed to the inside of the drying chamber; rotating the receiving member 197 about the center axis thereof in a rotational direction S; and rotating the undried honeycomb formed body 191 placed on the stand virtually about the center axis of the receiving member in the rotational direction S.

Figure 12:
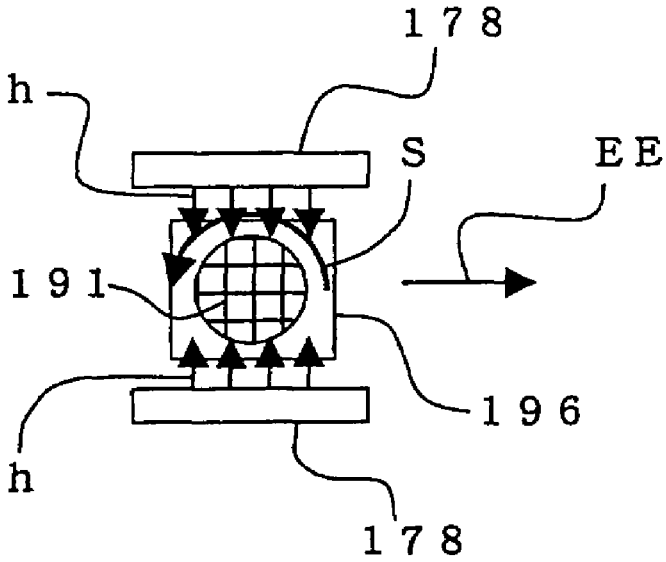
FIG. 12 A schematic plan view showing that hot air is applied to an undried honeycomb formed body which is rotating.

As shown in FIG. 12, the undried honeycomb formed body 191 is transferred in the direction EE while being supported by means of the support 196 of the stand and rotating in the rotational direction S. Preferably, a second hot air h is applied to the undried honeycomb formed body 191 in two directions so as to sandwich the structure by means of the hot air application apparatus 178 disposed so as to be aligned the direction EE and sandwich the undried honeycomb formed body 191. FIG. 12 is a schematic plan view showing that a second hot air h is applied to the undried honeycomb formed body 191 which is rotating.

Although the aforementioned combination of the pinion part and the rack part is employed as a mechanism for rotating the undried honeycomb formed body, other methods may also be employed. Examples include a method in which the member on which the undried honeycomb formed body is placed (i.e., receiving member) is directly rotated through a rotational driving system such as a motor; and a method in which a magnet or a like means is buried in the member on which the undried honeycomb formed body is placed (i.e., receiving member) and the member is rotated in a non-contact manner by means of an electromagnetic circuit.

As shown in FIG. 9, the drying apparatus 400 is provided with a hot air feeding unit 156 and an discharge means 163 for discharging the drying chamber 151. The drying space 152 of the drying chamber 151 can be controlled to a predetermined humidity and temperature through employment of the hot air feeding unit 156 and the forced discharge means 163. The atmosphere of the drying space 152 may be controlled through adjusting of the properties (i.e., temperature, humidity level, flow rate, and velocity) of the hot air fed through the hot air feeding unit 156. However, combination of the hot air feeding unit 156 and the forced discharge means 163 is preferred, since the atmosphere can be more precisely controlled. In addition, through provision of a water vapor feeding means (not illustrated) for feeding water vapor into the drying space 152, more precise atmosphere control can be realized. The forced discharge means 163 has a blower for forced discharge 161 and a duct for forced discharge 162 connected to the blower for forced discharge 161, and the duct for forced discharge 162 is communicated with the drying chamber 151. The atmosphere of the drying chamber 151 is discharged in order to control the atmosphere in the drying chamber 152 through the blower for forced discharge 161 via the duct for forced discharge 112.

In the case where the water vapor that is fed through the water vapor feeding means into the drying chamber 151, the water vapor preferably has a temperature of 100 to 120° C. The amount of water vapor fed into the drying chamber 151 and the amount of discharge from the drying chamber 151 to the outside through the blower for forced discharge 161 are appropriately determined in accordance with factors such as the capacity of the drying chamber 151, and the number and dimensions of honeycomb formed bodies accommodated in the drying chamber 151. For example, when the capacity of the drying chamber 151 is about 7 $m^3$, the water vapor in flow is preferably 90 to 120 kg/Hr, and the discharge rate is preferably 20 to 50 $m^3$/min.

As shown in FIG. 9, electromagnetic wave generators 153 are disposed on the inner surface of the ceiling 173 of the drying chamber 151 along the center axis of the outer frame 174. The electromagnetic wave generators 153 are distributed in ten zones located with virtually the same intervals. In each zone, as shown in FIG. 10, two electromagnetic wave generators are disposed on the ceiling 173 and one electromagnetic wave generator on each side surface 176; i.e., total four electromagnetic wave generators 153 are disposed. Thus, 40 electromagnetic wave generators 153 are disposed in the drying chamber 151. According to the embodiment of the honeycomb formed body drying method, the undried honeycomb formed body 191 is irradiated with an electromagnetic wave of the outer peripheral surface wall 194 side and the top end 195 side. Thus, the inside of the honeycomb formed body is more uniformly irradiated with an electromagnetic wave, and the entirety of the honeycomb formed body more uniformly undergoes high-frequency heating, which is preferred. No particular limitation is imposed on the place and number of the electromagnetic wave generators 153 to be disposed. For example, in each zone, one electromagnetic wave generator 153 may be placed at any place. Alternatively, five or more electromagnetic wave generators 153 may be disposed at any places. The number of the zones where an electromagnetic wave generator 153 is disposed is not limited to ten, and may be appropriately determined in accordance with factors such as the length of the drying chamber 151. The electromagnetic wave generators 153 are preferably disposed at such positions that an electromagnetic wave is applied to the undried honeycomb formed bodies 191 as uniformly as possible. Preferably, the drying chamber 151 is covered with a heat insulating material, whereby the inside temperature of the drying chamber 151 is maintained. In addition, the outer frame 174 is preferably surrounded by a heat insulating material.

In the embodiment of the honeycomb formed body drying method, the electromagnetic wave employed for drying preferably has a frequency of 900 to 10,000 MHz, more preferably 2,000 to 10,000 MHz. When the frequency is lower than 900 MHz, water is difficult to undergo high-frequency heating, and a honeycomb formed body may be difficult to dry. In contrast, when the frequency is higher than 2,000 MHz, water effectively undergoes high-frequency heating. As shown in FIG. 10, the electromagnetic wave generators 153 may be disposed inside the drying chamber 151. Alternatively, electromagnetic wave generators 153 may be disposed outside the drying chamber 151, and the generated electromagnetic wave is guided through a predetermined site of the drying chamber 151 into the drying chamber 151 via a waveguide so as to apply the electromagnetic wave to the undried honeycomb formed body 191.

The energy of the electromagnetic wave applied to the honeycomb formed body is appropriately determined in accordance with factors such as the capacity of the drying chamber 151, and the number and dimensions of honeycomb formed bodies accommodated in the drying chamber 151. For example, when the capacity of the drying chamber 151 is about 7 $m^3$, the total energy is preferably 150 to 300 kW. When the energy is smaller than 150 kW, the honeycomb formed body may fail to be dried to a predetermined drying degree, whereas when the energy is higher than 300 kW, the vaporization speed of water from the honeycomb formed body is elevated, difficulty may be encountered in reduction of the difference in drying condition between the inner part of the honeycomb formed body and the outer part thereof.

As shown in FIG. 9, the drying apparatus 400 of the present embodiment has a post-drying chamber 181 provided in the vicinity of the outlet of the outer frame 174 through which dried honeycomb formed bodies 192 are removed. The post-drying chamber 181 is disposed in the vicinity of the outlet of the outer frame 174 and has a space (post-drying space 187) between the ceiling 173 and the conveyer 171. As mentioned above, in the post-drying chamber 181, the dried honeycomb formed body 192 can be further dried through application of hot air (hot air for post-drying) thereto. Upon drying in the post-drying chamber 181, the dried honeycomb formed body 192 is transferred by means of a conveyer 171 to a post-drying chamber 181. The hot air for post-drying fed through hot air feeding nozzles 184 disposed under the post-drying chamber 181 is applied to the dried honeycomb formed body 192 in the direction from the bottom to the top end. The hot air fed through hot air feeding nozzles 184 to the post-drying chamber 181 is discharged to the outside through a hot air discharge duct 185 disposed above the post-drying chamber 181 (space between the ceiling 173 and the roof 175). The aforementioned hot air for post-drying preferably has a temperature of 100 to 130° C. When the temperature is lower than 100° C., the dried honeycomb formed body may be difficult to dry, whereas when the temperature is higher than 130° C., substances other than water such as an organic binder contained in the dried honeycomb formed body 192 are vaporized, causing deformation of partition walls of the dried honeycomb formed body 92 and burning of the organic binder and other substances, which are problematic.

The hot air feeding nozzles 184 are linked to the post-drying hot air generator 182 via a piping so that the hot air for post-drying generated by the post-drying hot air generator 182 is transferred via the piping and discharged through the hot air feeding nozzles 184. No particular limitation is imposed on the type of the post-drying hot air generator 182 so long as the generator attains predetermined temperature and flow rate. For example, a hot air generator having a heater employing high-temperature water vapor or an electric heater and a blower may be used. In the generator, a blow generated by the blower is heated to provide hot air. The hot air for post-drying generated by the post-drying hot air generator 182 may be used for preliminarily heating the unheated drying chamber 151 before the start of electromagnetic wave drying of the undried honeycomb formed body. In FIG. 9, hot air is fed into the drying chamber 151 via a piping for preliminary heating 186 connected to the post-drying hot air generator 182.

The honeycomb formed body to be dried by means of the drying apparatus of the embodiment is made of ceramic material, having a percent opening of 80% or more and a partition wall thickness of 0.18 mm or less. As used herein, the term "percent opening" refers to a ratio (percent) of the total cross-sectional area of the cell through-holes to the cross-sectional area of the honeycomb formed body in which the cell through-holes are located, as viewed in a cross-section of a honeycomb formed body cut in a direction normal to the center axis.

The drying apparatus of the embodiment continuously dries honeycomb formed bodies and may be a batch-type. In use, the batch-type drying apparatus is such that a predetermined number of undried honeycomb formed bodies are accommodated therein and irradiated with an electromagnetic wave to thereby dry the honeycomb formed bodies; irradiation of the electromagnetic wave is stopped; the thus-dried honeycomb formed bodies are removed; another predetermined number of undried honeycomb formed bodies are accommodated therein; and irradiation of an electromagnetic wave is started.

EXAMPLES

The present invention will next be described in more detail by way of examples, which should not be construed as limiting the invention thereto.

Example 1

Through employment of the drying apparatus 300 of the present invention (first mode) shown in FIG. 7, drying of honeycomb formed bodies was performed in accordance with the honeycomb formed body drying method according to the first mode of the present invention.

The following drying conditions were employed. An electromagnetic wave having a frequency of 2.45 GHz was generated by means of electromagnetic wave generators 53 each having an output power of 5 kW. As shown in FIG. 7, the electromagnetic wave generators 53 were distributed in ten zones located with virtually the same intervals. In each zone, as shown in FIG. 8, two electromagnetic wave generators were disposed on the ceiling 73 and one electromagnetic wave generator on each side surface 76; i.e., total four electromagnetic wave generators 53 were disposed. Thus, 40 electromagnetic wave generators (4 per zone) 53 were disposed so as to provide a total output power of 200 kW. The type of the electromagnetic wave generators 53 was a magnetron.

The inside humidity level of the drying space 52 was adjusted to 50%, and water vapor (120° C.) was fed into the drying space through a water vapor feeding means 54 at 120 kg/Hr. Air was discharge through a forced discharge means 55 at 60 $m^3$/min. The inside temperature of the drying space 52 was adjusted to about 105° C.

Each of the honeycomb formed bodies subjected to drying was made of cordierite and had a cell partition wall thickness of 0.15 mm, a percent opening of 80%, and a mass of about 6 kg.

Drying of honeycomb formed bodies was performed continuously by means of the drying apparatus 300 under such conditions that the drying chamber 51 had an accommodation capacity of 10 honeycomb formed bodies and the residence time of one honeycomb formed body in the drying space 52 was controlled to about 3 minutes.

Comparative Example 1

The same drying conditions as those of Example 1 were employed, except that the humidity level of the drying space was adjusted to 70%, water vapor (110° C.) was fed into the drying space through a water vapor feeding means at 30 kg/Hr, air was discharged through a forced discharge means at 60 $m^3$/min, and the inside temperature of the drying space was adjusted to about 90° C.

Visual Observation

The honeycomb formed bodies dried through the honeycomb formed body drying method of Example 1 or Comparative Example 1 were visually observed. In the honeycomb formed body obtained in Example 1, no wrinkles or defects of the outer peripheral surface walls or no deformations of the cell partition walls of the outer part of the honeycomb formed bodies were observed. In contrast, in the honeycomb formed bodies obtained in Comparative Example 1, wrinkles were-generated in outer peripheral surface walls, and deformations in cell partition walls present in the outer part of the honeycomb formed bodies were observed. The deformation of the partition wall of each of the honeycomb formed bodies obtained in Comparative Example 1 was found to be 20 mm inside from the outer peripheral surface wall.

Water Content Distribution in Honeycomb Formed Body

The honeycomb formed bodies dried through the honeycomb formed body drying method of Example 1 or Comparative Example 1 were investigated in terms of water content distribution (water content: mass %). In each of the dried honeycomb formed bodies, water content was determined in a center axis region, an outer peripheral surface wall region, and an intermediate region therebetween. In each region, the honeycomb formed body was divided into seven blocks along the center axis thereof from the top end to the bottom with the same intervals (1st block including the top end, 7th block including the bottom, and 2nd to 6th blocks being arranged from the top to the bottom). Thus, water content was determined in total 21 blocks. From each block, a sample (about 10 mm×10 mm) was cut out, and the weights of the sample immediately after cutting and that after complete drying were measured, thereby calculating water content immediately after cutting. The results are shown in Table 1.

TABLE 1

(Unit: mass %)

| | Ex. 1 | | | Comp. Ex. 1 | | |
|---|---|---|---|---|---|---|
| | Center axis | Inter-mediate region | Outer peripheral surface | Center axis | Inter-mediate region | Outer peripheral surface |
| 1st block | 22 | 23 | 23 | 30 | 33 | 40 |
| 2nd block | 19 | 22 | 23 | 20 | 22 | 38 |
| 3rd block | 19.5 | 21 | 25 | 20 | 22 | 40 |
| 4th block | 18 | 22 | 23 | 20 | 23 | 42 |
| 5th block | 19 | 21 | 24 | 21 | 24 | 40 |
| 6th block | 20 | 22 | 22.5 | 20 | 22 | 35 |
| 7th block | 15 | 18.5 | 19.5 | 15 | 18 | 30 |
| Average | 18.9 | 21.4 | 22.9 | 20.9 | 23.4 | 37.9 |
| In-carrier average | | 21 | | | 25 | |

As is clear from Table 1, the honeycomb formed bodies obtained in Example 1 had almost same water content in the center axis region, the intermediate region, and the outer peripheral surface wall region, whereas the honeycomb formed bodies obtained in Comparative Example 1 had a water content of the outer peripheral surface wall about 15 to 20 mass % higher as compared with the center axis region and the intermediate region. The results along with the above visual observation results indicate that drying performed in Example 1 reduces the water content of the outer peripheral surface wall through drying in a high-temperature, low-humidity atmosphere, thereby inhibiting wrinkles and defects of the outer peripheral surface wall and deformations of partition walls. These results also indicate that drying performed in Comparative Example 1 increases the water content of the outer peripheral surface wall through drying in a high-humidity atmosphere, thereby generating wrinkles the outer peripheral surface wall and deformations of cell partition walls. The average water content (in-carrier average) of each of the honeycomb formed bodies obtained in Example 1 is about 4 mass %-lower as compared with those obtained in Comparative Example 1, indicating that drying in Example 1 enhances drying efficiency by virtue of reduced humidity. As used herein, the term "in-carrier average" refers to a water content of the entirety of one honeycomb formed body.

Example 2 to 10

The procedure of Example 1 was repeated, except that the inside humidity and temperature of the drying space 2 were modified as specified in Table 2, to thereby dry honeycomb formed bodies. In each Example, the number of honeycomb formed bodies dried was 300.

Comparative Example 2 to 22

The procedure of Comparative Example 1 was repeated, except that the inside humidity and temperature of the drying space were modified as specified in Table 2, to thereby dry honeycomb formed bodies. In each Comparative Example, the number of honeycomb formed bodies dried was 300.

Visual Observation

In each of the Examples 2 to 10 and the Comparative Examples 2 to 22, 300 dried honeycomb formed bodies were visually observed. The results are shown in Table 2. In Table 2, the term "outer wall wrinkle" refers to a ratio (%) of the number of dried honeycomb formed body having wrinkles in the outer peripheral surface walls to the number of the dried honeycomb formed body in each of the Examples and Comparative Examples. The term "outer wall defect" refers to a ratio (%) of the number of dried honeycomb formed body having defects in the outer peripheral surface walls to the number of the dried honeycomb formed body in each of the Examples and Comparative Examples. As shown in Table 2, through controlling the inside humidity of the drying space to 30 to 65% at 75 to 130° C., wrinkles and defects of the outer peripheral surface wall can be prevented.

TABLE 2

| | Temperature in drying chamber (° C.) | Humidity level in drying chamber (%) | Defects in outer wall (%) | Wrinkles in outer wall (%) |
|---|---|---|---|---|
| Ex. 2 | 95 | 30 | 0 | 0 |
| Ex. 3 | 95 | 50 | 0 | 0 |
| Ex. 4 | 95 | 65 | 0 | 0 |
| Ex. 5 | 75 | 30 | 0 | 0 |
| Ex. 6 | 75 | 50 | 0 | 0 |
| Ex. 7 | 75 | 65 | 0 | 0 |
| Ex. 8 | 130 | 30 | 0 | 0 |
| Ex. 9 | 130 | 50 | 0 | 0 |
| Ex. 10 | 130 | 65 | 0 | 0 |
| Comp. Ex. 2 | 95 | 0 | 100 | 0 |
| Comp. Ex. 3 | 95 | 10 | 80 | 0 |
| Comp. Ex. 4 | 95 | 20 | 10 | 0 |
| Comp. Ex. 5 | 95 | 70 | 0 | 3 |
| Comp. Ex. 6 | 95 | 80 | 0 | 10 |
| Comp. Ex. 7 | 95 | 90 | 0 | 20 |
| Comp. Ex. 8 | 95 | 100 | 0 | 55 |
| Comp. Ex. 9 | 75 | 0 | 15 | 0 |
| Comp. Ex. 10 | 75 | 10 | 8 | 0 |
| Comp. Ex. 11 | 75 | 20 | 3 | 0 |
| Comp. Ex. 12 | 75 | 70 | 0 | 10 |
| Comp. Ex. 13 | 75 | 80 | 0 | 25 |
| Comp. Ex. 14 | 75 | 90 | 0 | 50 |
| Comp. Ex. 15 | 75 | 100 | 0 | 100 |
| Comp. Ex. 16 | 130 | 0 | 100 | 0 |
| Comp. Ex. 17 | 130 | 10 | 90 | 0 |
| Comp. Ex. 18 | 130 | 20 | 25 | 0 |
| Comp. Ex. 19 | 130 | 70 | 0 | 3 |
| Comp. Ex. 20 | 130 | 80 | 0 | 5 |
| Comp. Ex. 21 | 130 | 90 | 0 | 15 |
| Comp. Ex. 22 | 130 | 100 | 0 | 35 |

Example 11

Through employment of the drying apparatus 400 of the present invention (second mode) shown in FIG. 9, drying of honeycomb formed bodies was performed in accordance with the honeycomb formed body drying method according to the second mode of the present invention.

The following drying conditions were employed. An electromagnetic wave having a frequency of 2.45 GHz was generated by means of electromagnetic wave generators 153 each having an output power of 5 kW. As shown in FIG. 9, the electromagnetic wave generators 153 were distributed in ten zones located with virtually the same intervals. In each zone, as shown in FIG. 10, two electromagnetic wave generators were disposed on the ceiling 173 and one electromagnetic wave generator on each side surface 176; i.e., total four electromagnetic wave generators 153 were disposed. Thus, 40 electromagnetic wave generators (4 per zone) 153 were disposed so as to provide a total output power of 200 kW. The type of the electromagnetic wave generators 153 was a magnetron.

The employed hot air generator 154 of the hot air feeding unit 156 was an electric heater, and the heated air was fed by means of a blower. The hot air generated by means of the hot air generator 154 was introduced into the drying space 152 through the hot air introducing member 155. The hot air introduced into the drying space 152 was controlled to have a flow rate of 12 $m^3$/s, a velocity of 2 m/s, and a temperature of 105° C.

The hot air application apparatus 178 was disposed such that four nozzles whose tips facing the outer peripheral surface wall of the honeycomb formed body are aligned along the center axis (top to bottom) of the undried honeycomb formed body. Ten sets of four nozzles were aligned in parallel in the direction of transferring the undried honeycomb formed body. The total flow rate of the second hot air applied by means of a nozzle set of four nozzles aligned in the top-to-bottom direction was adjusted to 0.002 $m^3$/s. The second hot air fed through each nozzle was controlled to have a velocity of 3 m/s and a temperature of 105° C.

Air was discharged through a forced discharge means 63 at 60 $m^3$/min.

The inside humidity and temperature of the drying space 152 were adjusted to 50% and about 105° C., respectively.

Each of the honeycomb formed bodies subjected to drying was made of cordierite and had a cell partition wall thickness of 0.13 mm, a percent opening of 83%, and a mass of about 6 kg.

Drying of honeycomb formed bodies was performed continuously by means of the drying apparatus 400 under such conditions that the drying chamber 151 had an accommodation capacity of 10 honeycomb formed bodies and the residence time of one honeycomb formed body in the drying space 152 was controlled to about 3 minutes.

Comparative Example 23

The same drying conditions as those of Example 11 were employed, except that the humidity level of the drying space was adjusted to 70%, water vapor (110° C.) was fed into the drying space through a water vapor feeding means at 30 kg/Hr, air was discharged through a forced discharge means at 60 $m^3$/min, the inside temperature of the drying space was adjusted to about 90° C., and feeding of hot air through the hot air feeding unit and application of the second hot air through the hot air application apparatus were not performed.

Visual Observation

The honeycomb formed bodies dried through the honeycomb formed body drying method of Example 11 or Comparative Example 23 were visually observed. In the honeycomb formed body obtained in Example 11, no wrinkles or defects of the outer peripheral surface walls or no deformations of the cell partition walls of the outer part of the honeycomb formed bodies were observed. In contrast, in the honeycomb formed bodies obtained in Comparative Example 23, wrinkles were generated in outer peripheral surface walls, and cell partition walls in the outer part of the honeycomb formed bodies were observed. The deformation of the partition wall of each of the honeycomb formed bodies obtained in Comparative Example 23 was found to be 20 mm inside from the outer peripheral surface wall.

Water Content Distribution in Honeycomb Formed Body

The honeycomb formed bodies dried through the honeycomb formed body drying method of Example 11 or Comparative Example 23 were investigated in terms of water content distribution (water content: mass %). In each of the dried honeycomb formed bodies, water content was determined in a center axis region, an outer peripheral surface wall region, and an intermediate region therebetween. In each region, the honeycomb formed body was divided into seven blocks along the center axis thereof from the top end to the bottom with the same intervals (1st block including the top end, 7th block including the bottom, and 2nd to 6th blocks being arranged from the top to the bottom). Thus, water content was determined in total 21 blocks. From each block, a sample (about 10 mm×10 mm) was cut out, and the weights of the sample immediately after cutting and that after complete drying were measured, thereby calculating water content immediately after cutting. The results are shown in Table 1. Complete drying was performed in a hot air atmosphere at 120° C. for 24 hours.

TABLE 3

(Unit: mass %)

| | Ex. 11 | | | Comp. Ex. 23 | | |
|---|---|---|---|---|---|---|
| | Center axis | Inter-mediate region | Outer peripheral surface | Center axis | Inter-mediate region | Outer peripheral surface |
| 1st block | 20 | 21 | 21 | 30 | 33 | 40 |
| 2nd block | 18 | 19 | 19 | 20 | 22 | 38 |
| 3rd block | 18 | 19 | 19 | 20 | 22 | 40 |
| 4th block | 17.5 | 19.5 | 19 | 20 | 23 | 42 |
| 5th block | 18 | 19 | 19.5 | 21 | 24 | 40 |
| 6th block | 18.5 | 19 | 19.5 | 20 | 22 | 35 |
| 7th block | 15 | 18.5 | 19.5 | 15 | 18 | 30 |
| Average | 17.9 | 19.3 | 19.5 | 20.9 | 23.4 | 37.9 |
| In-carrier average | | 19.5 | | | 25.7 | |

As is clear from Table 3, the honeycomb formed bodies obtained in Example 11 had almost same water content in the center axis region, the intermediate region, and the outer peripheral surface wall region, whereas the honeycomb formed bodies obtained in Comparative Example 23 had a water content of the outer peripheral surface wall about 15 to 20 mass % higher as compared with the center axis region and the intermediate region. The results along with the above visual observation results indicate that drying performed in Example 11 reduces the water content of the outer peripheral surface wall through drying in a high-temperature, low-humidity atmosphere, thereby inhibiting wrinkles and defects of the outer peripheral surface wall and deformations of partition walls. These results also indicate that drying performed in Comparative Example 23 increases the water content of the outer peripheral surface wall through drying in a high-humidity atmosphere, thereby generating wrinkles the outer peripheral surface wall and deformations of cell partition walls. The average water content (in-carrier average) of each of the honeycomb formed bodies obtained in Example 11 is about 6.2 mass %-lower as compared with those obtained in Comparative Example 23, indicating that drying in Example 11 enhances drying efficiency by virtue of reduced humidity. As used herein, the term "in-carrier average" refers to a water content of the entirety of one honeycomb formed body, and is calculated by subtracting the mass (B) of the completely dried honeycomb formed body from the mass (A) of the entire honeycomb formed body, dividing the difference (B-A) by the mass (A) of the entire honeycomb formed body before drying, and multiplying 100.

Example 12 to 20

The procedure of Example 11 was repeated, except that the inside humidity and temperature of the drying space 152 were modified as specified in Table 4, to thereby dry honeycomb formed bodies. In each Example, the number of honeycomb formed bodies dried was 300.

Comparative Example 24 to 44

The procedure of Comparative Example 23 was repeated, except that the inside humidity and temperature of the drying space were modified as specified in Table 4, to thereby dry honeycomb formed bodies. In each Comparative Example, the number of honeycomb formed bodies dried was 300.

Visual Observation

In each of the Examples 12 to 20 and the Comparative Examples 24 to 44, 300 dried honeycomb formed bodies were visually observed. The results are shown in Table 4. In Table 4, the term "outer wall wrinkle" refers to a ratio (%) of the number of dried honeycomb formed body having wrinkles in the outer peripheral surface walls to the number of the dried honeycomb formed body in each of the Examples and Comparative Examples. The term "outer wall defect" refers to a ratio (%) of the number of dried honeycomb formed body having defects in the outer peripheral surface walls to the number of the dried honeycomb formed body in each of the Examples and Comparative Examples. As shown in Table 4, through controlling the inside humidity of the drying space to 30 to 65% at 75 to 130° C., wrinkles and defects of the outer peripheral surface wall can be prevented.

TABLE 4

| | Temperature in drying chamber (° C.) | Humidity level in drying chamber (%) | Defects in outer wall (%) | Wrinkles in outer wall (%) |
|---|---|---|---|---|
| Ex. 12 | 95 | 30 | 0 | 0 |
| Ex. 13 | 95 | 50 | 0 | 0 |
| Ex. 14 | 95 | 65 | 0 | 0 |
| Ex. 15 | 75 | 30 | 0 | 0 |
| Ex. 16 | 75 | 50 | 0 | 0 |
| Ex. 17 | 75 | 65 | 0 | 0 |
| Ex. 18 | 130 | 30 | 0 | 0 |
| Ex. 19 | 130 | 50 | 0 | 0 |
| Ex. 20 | 130 | 65 | 0 | 0 |
| Comp. Ex. 24 | 95 | 0 | 100 | 0 |
| Comp. Ex. 25 | 95 | 10 | 80 | 0 |
| Comp. Ex. 26 | 95 | 20 | 10 | 0 |
| Comp. Ex. 27 | 95 | 70 | 0 | 3 |
| Comp. Ex. 28 | 95 | 80 | 0 | 10 |
| Comp. Ex. 29 | 95 | 90 | 0 | 20 |
| Comp. Ex. 30 | 95 | 100 | 0 | 55 |
| Comp. Ex. 31 | 75 | 0 | 15 | 0 |

TABLE 4-continued

| | Temperature in drying chamber (° C.) | Humidity level in drying chamber (%) | Defects in outer wall (%) | Wrinkles in outer wall (%) |
|---|---|---|---|---|
| Comp. Ex. 32 | 75 | 10 | 8 | 0 |
| Comp. Ex. 33 | 75 | 20 | 3 | 0 |
| Comp. Ex. 34 | 75 | 70 | 0 | 10 |
| Comp. Ex. 35 | 75 | 80 | 0 | 25 |
| Comp. Ex. 36 | 75 | 90 | 0 | 50 |
| Comp. Ex. 37 | 75 | 100 | 0 | 100 |
| Comp. Ex. 38 | 130 | 0 | 100 | 0 |
| Comp. Ex. 39 | 130 | 10 | 90 | 0 |
| Comp. Ex. 40 | 130 | 20 | 25 | 0 |
| Comp. Ex. 41 | 130 | 70 | 0 | 3 |
| Comp. Ex. 42 | 130 | 80 | 0 | 5 |
| Comp. Ex. 43 | 130 | 90 | 0 | 15 |
| Comp. Ex. 44 | 130 | 100 | 0 | 35 |

INDUSTRIAL APPLICABILITY

The invention provides a method and an apparatus for drying a honeycomb formed body which prevent deformation such as warpage of partition walls of a honeycomb formed body during drying thereof in the production of the honeycomb formed body, particularly a ceramic honeycomb formed body, whereby a high-quality honeycomb formed body free of deformation can be produced.

The invention claimed is:

1. A method for drying a honeycomb formed body including subjecting, to high-frequency heating through electromagnetic wave irradiation, a honeycomb formed body in an undried state (i.e., undried honeycomb formed body) which is formed from a raw material composition containing a ceramic raw material and water and which has a plurality of cells defined by partition walls, in a drying space of a humidified and heated atmosphere, whereby water is vaporized from an inner part and an outer part of the undried honeycomb formed body to dry the undried honeycomb formed body, thereby producing a dried honeycomb formed body, wherein the humidified and heated atmosphere in the drying space is maintained at a humidity level of 30 to 65% and a temperature of 75 to 130° C. through feeding water vapor from a water vapor generator into and forcedly discharging the drying space; and the undried honeycomb formed body is subjected to high-frequency heating in the atmosphere through electromagnetic wave irradiation such that 50 to 99 mass % of water contained in the formed body is evaporated at the end of high-frequency heating, whereby the amount of water vaporized from the outer part of the undried honeycomb formed body, which amount is smaller than that of water vaporized from the inner part of the formed body through high-frequency heating alone, is increased, thereby reducing a difference between amount of water vaporized from the inner part of the undried honeycomb formed body and that of water vaporized from the outer part thereof as well as reducing a difference between drying degree of the inner part of the undried honeycomb formed body and that of the outer part thereof, thereby producing a dried honeycomb formed body in which deformation of the partition walls caused by the difference between drying degree of the inner part and that of the outer part is surpassed, wherein, after drying of the honeycomb formed body through high-frequency heating, the honeycomb formed body is further dried through application of hot air thereto, the hot air being different from the water vapor.

2. A method for drying a honeycomb formed body as described in claim 1, wherein the hot air has a temperature of 100 to 130° C.

3. A method for drying a honeycomb formed body as described in claim 1, wherein the electromagnetic wave has a frequency of 900 to 10,000 MHz.

4. A method for drying a honeycomb formed body as described in claim 1, wherein the honeycomb formed body has a percent cell opening of 80% or more, and each of the partition walls has a thickness of 0.18 mm or less.

5. A method for drying a honeycomb formed body including subjecting, to high-frequency heating through electromagnetic wave irradiation, a honeycomb formed body in an undried state (i.e., undried honeycomb formed body) which is formed from a raw material composition containing a ceramic raw material and water and which has a plurality of cells defined by partition walls, in a drying space of a humidified and heated atmosphere, whereby water is vaporized from an inner part and an outer part of the undried honeycomb formed body to dry the undried honeycomb formed body, thereby producing a dried honeycomb formed body, wherein the undried honeycomb formed body is subjected to high-frequency heating in the atmosphere through electromagnetic wave irradiation such that 50 to 99 mass % of water contained in the formed body is evaporated at the end of high-frequency heating, while the humidified and heated atmosphere in the drying space is maintained at a humidity level of 30 to 65% and a temperature of 75 to 130° C.; and hot air is fed into the drying space so as to apply the hot air to the undried honeycomb formed body, whereby the amount of water vaporized from the outer part of the undried honeycomb formed body, which amount is smaller than that of water vaporized from the inner part of the formed body through high-frequency heating alone, is increased, thereby reducing a difference between amount of water vaporized from the inner part of the undried honeycomb formed body and that of water vaporized from the outer part thereof as well as reducing a difference between drying degree of the inner part of the undried honeycomb formed body and that of the outer part thereof, thereby producing a dried honeycomb formed body in which deformation of the partition walls caused by the difference between drying degree of the inner part and that of the outer part is suppressed.

6. A method for drying a honeycomb formed body as described in claim 5, wherein the hot air is fed into the drying space at a velocity of 0.5 to 10 m/s and a flow rate of 3 to 60 $m^3/s$.

7. A method for drying a honeycomb formed body as described in claim 5, wherein the hot air fed into the drying space has a temperature of 80 to 135° C.

8. A method for drying a honeycomb formed body as described in claim 5, wherein the hot air fed into the drying space has a humidity level of 20% or less.

9. A method for drying a honeycomb formed body as described in claim 5, wherein the honeycomb formed body is dried in the drying space while the structure is rotated about the center axis thereof.

10. A method for drying a honeycomb formed body as described in claim 5, wherein, in addition to the hot air fed into the drying space, hot air (second hot air) is further applied to an outer peripheral wall of the undried honeycomb formed body at a predetermined distance from the wall, to thereby dry the undried honeycomb formed body.

11. A method for drying a honeycomb formed body as described in claim 10, wherein the second hot air applied to the outer peripheral wall of the undried honeycomb formed body has a velocity of 0.5 to 10 m/s.

12. A method for drying a honeycomb formed body as described in claim 10, wherein the second hot air applied to the outer peripheral wall of the undried honeycomb formed body has a temperature of 80 to 135° C.

13. A method for drying a honeycomb formed body as described in claim 10, wherein the second hot air applied to the outer peripheral wall of the undried honeycomb formed body has a humidity level of 20% or less.

14. A method for drying a honeycomb formed body as described in claim 5, wherein the humidity and temperature of the drying space are controlled through feeding the hot air into and forcedly discharging the drying space.

15. A method for drying a honeycomb formed body as described in claim 5, wherein after drying of the honeycomb formed body through high-frequency heating, the honeycomb formed body is further dried through application of the hot air (hot air for post-drying) thereto.

16. A method for drying a honeycomb formed body as described in claim 15, wherein the hot air for post-drying has a temperature of 100 to 130° C.

17. A method for drying a honeycomb formed body as described in claim 5, wherein the electromagnetic wave has a frequency of 900 to 10,000 MHz.

18. A method for drying a honeycomb formed body as described in claim 5, wherein the honeycomb formed body has a percent cell opening of 80% or more, and each of the partition walls has a thickness of 0.18 mm or less.

19. An apparatus for drying a honeycomb formed body, in use, which is capable of performing subjecting, to high-frequency heating through electromagnetic wave irradiation, a honeycomb formed body in an undried state (i.e., undried honeycomb formed body) which is formed from a raw material composition containing a ceramic raw material and water and which has a plurality of cells defined by partition walls, in a drying space of a humidified and heated atmosphere, whereby water is vaporized from an inner part and an outer part of the undried honeycomb formed body to dry the undried honeycomb formed body, thereby producing a dried honeycomb formed body, the apparatus comprising a drying chamber having a drying space for accommodating the undried honeycomb formed body in a humidified and heated atmosphere; an electromagnetic wave generator for generating the electromagnetic wave with which the undried honeycomb formed body accommodated in the drying chamber is to be irradiated such that 50 to 99 mass % of water contained in the undried formed body is evaporated at the end of irradiation; and an atmosphere controlling unit having a water vapor feeding means and a forced discharge means and allowing the humidified and heated atmosphere in the drying space to be maintained at a humidity level of 30 to 65% and a temperature of 75 to 130° C., the water vapor feeding means feeding water vapor generated by a water vapor generator into the drying space, wherein the undried honeycomb formed body accommodated in the drying chamber in which humidified and heated atmosphere is maintained by means of the atmosphere controlling unit is irradiated with an electromagnetic wave generated by the electromagnetic wave generator, whereby the amount of water vaporized from the outer part of the undried honeycomb formed body, which amount is smaller than that of water vaporized from the inner part of the formed body through high-frequency heating alone, is increased, thereby reducing a difference between amount of water vaporized from the inner part of the undried honeycomb formed body and that of water vaporized from the outer part thereof as well as reducing a difference between drying degree of the inner part of the undried honeycomb formed body and that of the outer part thereof, thereby producing a dried honeycomb formed body in which deformation of the partition walls caused by the difference between drying degree of the inner part and that of the outer part is suppressed.

20. An apparatus for drying a honeycomb formed body as described in claim 19, wherein the drying chamber has a heat insulating material covering the same.

21. An apparatus for drying a honeycomb formed body as described in claim 19, wherein the electromagnetic wave has a frequency of 900 to 10,000 MHz.

22. An apparatus for drying a honeycomb formed body as described in claim 19, which further comprises a hot air drying chamber having a hot air drying space for accommodating the honeycomb formed body which has been dried in the drying space included in the drying chamber wherein the honeycomb formed body is further dried through application of hot air thereto in the hot air drying space, and a hot air generator for generating the hot air.

23. An apparatus for drying a honeycomb formed body as described in claim 22, wherein the hot air has a temperature of 100 to 130° C.

24. An apparatus for drying a honeycomb formed body as described in claim 19, wherein the honeycomb formed body has a percent cell opening of 80% or more, and each of the partition walls has a thickness of 0.18 mm or less.

25. An apparatus for drying a honeycomb formed body, in use, which is capable of performing subjecting, to high-frequency heating through electromagnetic wave irradiation, a honeycomb formed body in an undried state (i.e., undried honeycomb formed body) which is formed from a raw material composition containing a ceramic raw material and water and which has a plurality of cells defined by partition walls, in a drying space of a humidified and heated atmosphere, whereby water is vaporized from an inner part and an outer part of the undried honeycomb formed body to dry the undried honeycomb formed body, thereby producing a dried honeycomb formed body, the apparatus comprising a drying chamber having a drying space for accommodating the undried honeycomb formed body in a humidified and heated atmosphere; an electromagnetic wave generator for generating the electromagnetic wave with which the undried honeycomb formed body accommodated in the drying chamber is to be irradiated for high-frequency heating thereof; and a hot air feeding unit for feeding hot air into the drying chamber, which hot air feeding unit being provided so that the amount of water vaporized from the outer part of the undried honeycomb formed body, which amount is smaller than that of water vaporized from the inner part of the formed body through high-frequency heating alone, is increased synergistic with the high-frequency heating performed by means of the electromagnetic wave generator, such that 50 to 99 mass % of water contained in the undried formed body is evaporated at the end of irradiation, and the humidified and heated atmosphere in the drying space is maintained at a humidity level of 30 to 65% and a temperature of 75 to 130° C., wherein the undried honeycomb formed body accommodated in the drying chamber in which humidified and heated atmosphere is maintained by means of the hot air feeding unit is irradiated with an electromagnetic wave generated by the electromagnetic wave generator, thereby performing high-frequency heating, and the hot air fed by the hot air feeding unit is applied to the undried honeycomb formed body, thereby increasing the amount of water vaporized from the outer part, thereby reducing a difference between amount of water vaporized from the inner part of the undried honeycomb formed body and that of water vaporized from the outer part thereof as well as reducing a difference between drying degree of the inner part of the undried honeycomb formed body and that of the outer part thereof, thereby producing a dried honeycomb formed body in which deformation of the partition walls caused by the difference between drying degree of the inner part and that of the outer part is suppressed.

26. An apparatus for drying a honeycomb formed body as described in claim 25, wherein the hot air feeding unit has a hot air generator and a hot air introduction member for introducing, into the drying chamber, the hot air generated by means of the hot air generator.

27. An apparatus for drying a honeycomb formed body as described in claim 25, wherein the hot air is fed by means of the hot air feeding unit at a velocity of 0.5 to 10 m/s and a flow rate of 3 to 60 $m^3$/s.

28. An apparatus for drying a honeycomb formed body as described in claim 25, wherein the hot air fed by means of the hot air feeding unit has a temperature of 80 to 135° C.

29. An apparatus for drying a honeycomb formed body as described in claim 25, wherein the hot air fed by means of the hot air feeding unit has a humidity level of 20% or less.

30. An apparatus for drying a honeycomb formed body as described in claim 25, which further comprises a hot air application apparatus for further applying hot air (second hot air) to an outer peripheral wall of the undried honeycomb formed body accommodated in the drying chamber at a predetermined distance from the wall, to thereby heat the undried honeycomb formed body.

31. An apparatus for drying a honeycomb formed body as described in claim 30, wherein the hot air application apparatus has a second hot air application section for applying a second hot air; and the second hot air application section is formed such that the second hot air is applied to the outer peripheral wall in two directions opposing each other and being normal to the center axis of the undried honeycomb formed body, whereby the second hot air is applied to the undried honeycomb formed body in two directions so as to sandwich the outer peripheral wall.

32. An apparatus for drying a honeycomb formed body as described in claim 30, wherein the second hot air is applied by means of the hot air application apparatus to the outer peripheral wall of the undried honeycomb formed body at a velocity of 0.5 to 10 m/s.

33. An apparatus for drying a honeycomb formed body as described in claim 30, wherein the second hot air applied by means of the hot air application apparatus to the outer wall of the undried honeycomb formed body has a temperature of 80 to 135° C.

34. An apparatus for drying a honeycomb formed body as described in claim 30, wherein the second hot air applied by means of the hot air application apparatus to the outer wall of the undried honeycomb formed body has a humidity level of 20% or less.

35. An apparatus for drying a honeycomb formed body as described in claim 25, which further comprises a stand having a rotatable receiving member and a support for rotatably supporting the receiving member, the receiving member being capable of rotating the undried honeycomb formed body placed on an upper surface thereof virtually about the center axis of the receiving member, wherein the undried honeycomb formed body is placed on the receiving member of the stand during drying of the undried honeycomb formed body in the drying chamber;

the undried honeycomb formed body and the stand are transferred into the drying chamber;

the undried honeycomb formed body is dried while the undried honeycomb formed body is rotated through rotation of the receiving member, to thereby provide a dried honeycomb formed body; and the dried honeycomb formed body and the stand are removed from the drying chamber.

36. An apparatus for drying a honeycomb formed body as described in claim 35, wherein the receiving member forming the stand has a pinion part for allowing the receiving member to rotate about the center axis;

the drying chamber further contains a conveyer and a rod-like rack part provided along the conveyer, the conveyer being adapted such that the undried honeycomb formed body placed on the stand is placed thereon and transferred to the drying chamber; the undried honeycomb formed body is dried while being transferred, to thereby provide a dried honeycomb formed body; and the dried honeycomb formed body is removed from the drying chamber, and the rod-like rack part being disposed along the conveyer, being aligned in the longitudinal direction of the conveyer, and having rack part teeth formed on one side facing the stand and along the conveyer such that the rack part teeth are engaged with the pinion part of the receiving member during transfer of the undried honeycomb formed body placed on the stand by means of the conveyer, wherein, during transfer of the undried honeycomb formed body placed on the stand by means of the conveyer in the drying chamber, the stand is transferred while the rack part teeth are engaged with the pinion part of the receiving member, thereby rotating the receiving member about the center axis thereof, whereby the undried honeycomb formed body placed on the stand is transferred in the drying chamber while rotating virtually about the center axis of the receiving member.

37. An apparatus for drying a honeycomb formed body as described in claim 25, wherein the drying chamber has a heat insulating material covering the same.

38. An apparatus for drying a honeycomb formed body as described in claim 26, wherein the electromagnetic wave has a frequency of 900 to 10,000 MHz.

39. An apparatus for drying a honeycomb formed body as described in claim 25, which further comprises a post-drying chamber having a post-drying space for accommodating the honeycomb formed body which has been dried in the drying space included in the drying chamber wherein the honeycomb formed body is further dried through application of the hot air (for post-drying) thereto, and a post-drying hot air generator for generating the hot air for post-drying.

40. An apparatus for drying a honeycomb formed body as described in claim 39, wherein the hot air for post-drying generated by means of the post-drying hot air generator has a temperature of 100 to 130° C.

41. An apparatus for drying a honeycomb formed body as described in claim 25, wherein the honeycomb formed body has a percent cell opening of 80% or more, and each of the partition walls has a thickness of 0.18 mm or less.

* * * * *